United States Patent [19]

Rösler et al.

[11] 4,357,853

[45] Nov. 9, 1982

[54] DIGITAL SEMICONDUCTOR CIRCUIT FOR AN ELECTRONIC ORGAN

[75] Inventors: Helmut Rösler, Munich; Klaus-Dieter Bigall, Vaterstetten, both of Fed. Rep. of Germany

[73] Assignee: Siemens Aktiengesellschaft, Berlin and Munich, Fed. Rep. of Germany

[21] Appl. No.: 210,373

[22] Filed: Nov. 26, 1980

[30] Foreign Application Priority Data

Dec. 4, 1979 [DE] Fed. Rep. of Germany ..... 2948769

[51] Int. Cl.[3] ..... G10H 1/46; G10H 5/00

[52] U.S. Cl. ..... 84/1.27; 84/1.01

[58] Field of Search ..... 84/1.01, 1.03, 1.22, 84/1.27

[56] References Cited

U.S. PATENT DOCUMENTS 4,287,802 9/1981 Imamura et al. ..... 84/1.22

FOREIGN PATENT DOCUMENTS 2713319 9/1978 Fed. Rep. of Germany .

*Primary Examiner*—S. J. Witkowski

*Attorney, Agent, or Firm*—Herbert L. Lerner; Laurence A. Greenberg

[57] ABSTRACT

Digital semiconductor circuit having a plurality of control inputs addressed via a keyboard corresponding to the number of keys on an organ keyboard, as well as having a plurality of audio signal inputs addressable by an oscillator arrangement with periodic electrical oscillations, each control input being permanently assigned to a key of the keyboard and each audio signal input of an audio frequency, and further having respective audio frequency outputs provided for driving an electroacoustical transducer, the control inputs being addressable by control signals corresponding to the logic levels, including a clock-controlled shift register operated as a parallel-to-series converter and having respective cells to which the respective control inputs are assigned, the shift register having a signal output, a switching system controllable by the signal output of the shift register and by clock pulses provided for the operation of the shift register, the switching system having the totality of the audio signal inputs, the audio frequency outputs being less in number than that of the control inputs, and a respective amplitude former or controller assigned to each of the audio signal outputs, the amplitude formers or controllers having outputs connected to the electroacoustic transducer.

40 Claims, 10 Drawing Figures a6
a5
a4
a3
a2
a1
F6
F5
F4
F3
F2
F1
TL2
TL1
OZ2
OZ1
IR
od
ug
≧1
&
LFF
Lo
FS
V1 ····· V10
AU1 ····· AU10
AF1
AF9
AF10
Mi
V
LT
a1* a2* a3*
a3*
a2*
a1*
Z
DS2
AFF
n6
n5
n4
n3
n2
n1
DS1
St
Re

DIGITAL SEMICONDUCTOR CIRCUIT FOR AN ELECTRONIC ORGAN

The invention relates to a digital semiconductor circuit for an electronic organ having a number of control inputs corresponding to the number of keys on the organ keyboard, the control inputs being addressed via the keyboard, as well as having a number of audio signals inputs addressed by an oscillator arrangement with periodic electrical oscillations, each control input, respectively, being permanently assigned to a respective key of the keyboard and each audio signal input, respectively, to a respective audio frequency, an audio signal output being further provided for driving an electro-acoustic transducer and the control signals serving for addressing the control inputs being in correspondence with the logic levels.

In heretofore known digital semiconductor circuits of this general type, the individual control inputs are addressed, for example, in a manner wherein each of these control inputs is connectible via a respective switch to a common first supply potential assigned to the level "1" and, when the individual keys are operated or actuated, the respective switch assigned thereto is closed due to the operation or actuation. Control inputs, the keys of which are pressed, have the level "1", and control inputs, the keys of which are not operated or actuated, have the level "0" correspondingly. In the heretofore known electric organs, a generator for generating the audio frequencies is used, furthermore, which, starting with an oscillator supplying a squarewave of the highest frequency corresponding to the two logic levels, supplies the individual audio oscillations at least of the highest octave of the organ by frequency division and feeds them to the one input of a respective AND gate having two inputs, the second input of which is addressed by the corresponding control input. All of these AND gates are then provided for driving the audio signal outputs.

The possibility then exists of assigning such an amplitude former or controller, respectively, to each key and, therefore, to each input of the digital semiconductor circuit of the electronic organ. The circuitry required therefor, however, is undesirably extensive, especially when the semiconductor circuit is of monolithic construction. On the other hand, for musical reasons, it is impossible to provide overall only one signal output of the digital circuit of the organ and, accordingly, only a single amplitude former or controller. This means that the digital semiconductor circuit of the organ must be provided with several signal outputs, especially ten, sensibly, which are then respectively connected to the respective input of an amplitude former circuit. All of the amplitude formers or controllers are then connected to a common output for driving an electro-acoustic transducer, especially a loudspeaker.

For this purpose, provision is made, in accordance with the invention, that the individual control inputs are associated with a respective cell of a clock-controlled shift register operated as a parallel-to-series converter; that further, the signal output of the shift register, as well as the clock pulses provided for the operation thereof, serve for controlling a switching system which is provided, on the other hand, with all of the provided audio signal inputs; that further, the number of the audio signal outputs is smaller than the number of the control inputs and also a respective amplitude former or controller is associated with each of the audio signal outputs; and that the outputs of the amplitude formers or controllers are connected to an electro-acoustic transducer.

In one preferred embodiment of the invention, a total of 5 octaves and one key, i.e. 61 keys, are provided in the keyboard of the organ, and, accordingly, 61 control inputs in the digital semiconductor circuit according to the invention. In the general case, another number, for example 75, may also be provided for the number n of the keys and, therefore, for the number n of the control inputs. The number m of the audio signal inputs is fixed, for example, as $m=12$, while the number p of the audio signal outputs and, therefore, the number of the amplitude formers or controllers provided in the circuit, is preferably $p=10$. The heart of the invention is the switching system, the objective of further embodiments of the invention being to construct the switching system in accordance with at least one of the following aspects:

1. The p audio signal outputs of the switching system are numbered, i.e. connected in accordance with a hierarchy.

2. All of the n control inputs are periodically interrogated i.e. the shift register is emptied into the switching system. What is sought after, in this regard, is that between two successive interrogations, the respective key first depressed and the control input respectively, assigned thereto are switched to the first audio signal output, and the key next depressed is connected to the second audio signal input in accordance with the hierarchy mentioned under paragraph 1 hereinbefore. As already noted, the number p of the audio signal outputs is preferably fixed at $p=10$ (according to the number of fingers). In addition, the time interval between successive interrogation cycles is made so short that it corresponds at most to the time interval needed by the fastest player for playing a chord. In general, it can therefore be expected that, at most, one further information per interrogation cycle is entered from the keyboard into the shift register which is operated as a parallel-to-series converter.

In case that, contrarywise more than p control inputs are addressed between two successive interrogations i.e. more than ten notes are played, for example, the excess information is to be ignored, taking the hierarchy indicated under the foregoing paragraphs 1 and 2 into consideration.

3. Once an audio signal output or channel is occupied, there is a striving to release it again only if, after the key causing the occupation is released, the tone and, therefore, the electrical information causing the tone, has decayed in the amplitude former or controller addressed by the audio signal output. On the other hand, a reverberation effect is provided, so that the tone played is not abruptly suppressed with the release of the key.

If a key is released while the audio signal outputs are fully occupied, and another key is struck in place thereof, the new tone is to be generated via that audio signal output which has become available by the release of the other key. If several keys are released simultaneously and if a new key is actuated or operated, while the audio signal outputs are fully occupied, the information associated with the new key and the audio signal called up thereby are to be applied to those of the audio signal outputs made available thereby at which the tone, which was played last and remains yet in reverberating effect, has decayed farthest. If, finally, a released key is struck again immediately, it is advisable to assign the old audio signal output of the switching system again thereto.

Other features which are considered as characteristic for the invention are set forth in the appended claims.

Although the invention is illustrated and described herein as embodied in a digital semiconductor circuit for an electronic organ, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
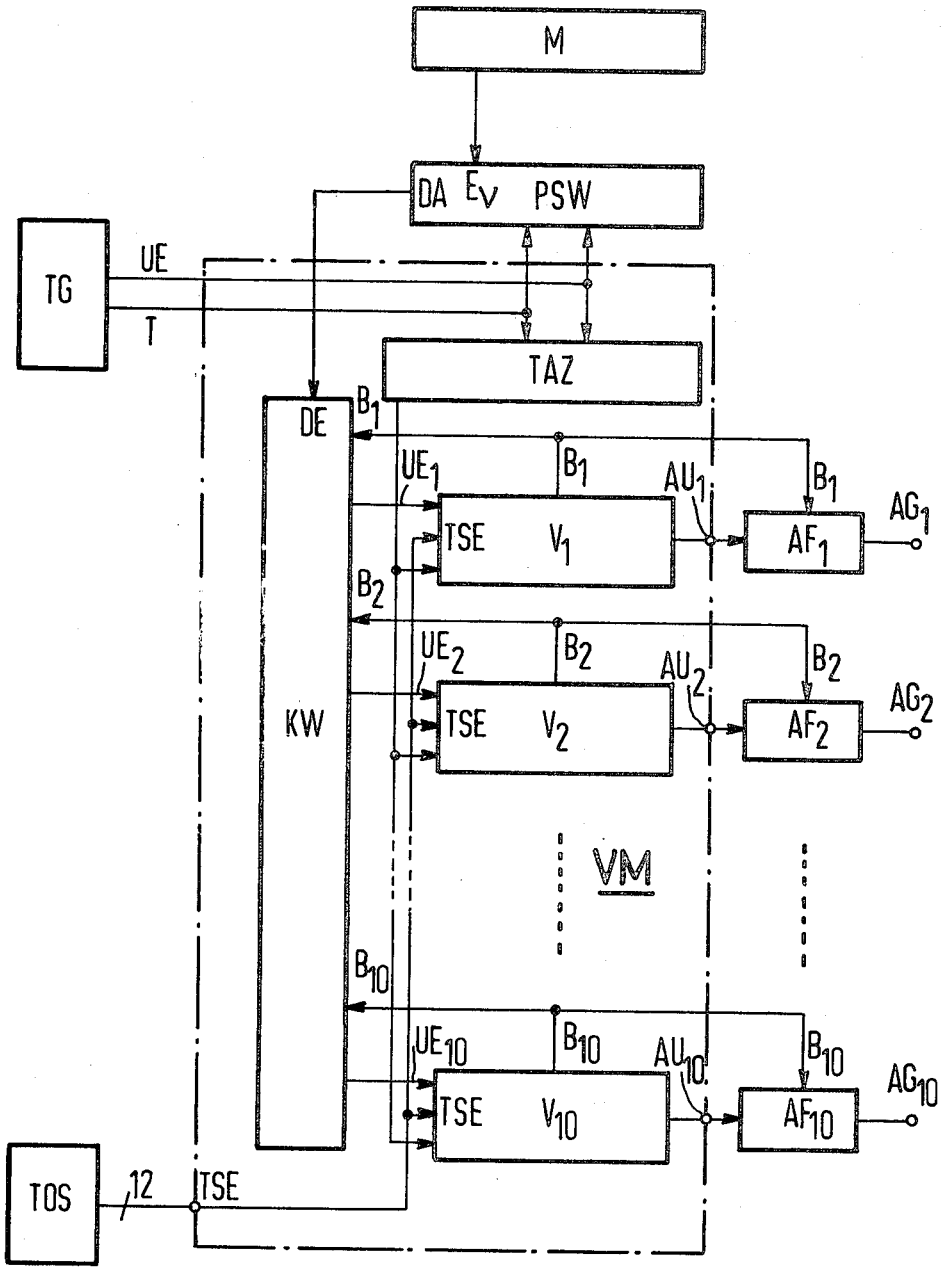
FIG. 1 is a block diagram showing the essential parts of the invention.

Referring now to the drawing and first, particularly, to FIG. 1 thereof, there is apparent that, in the previously indicated manner, n control inputs $E_1, E_2, \ldots E_n$, or $E_\nu$ for short, of the digital semiconductor circuit according to the invention are acted upon by the individual keys of the keyboard M. These n control inputs $E_\nu$ form the information input of each register cell of a clock-controlled shift register PSW, which is operated as a parallel-to-series converter and is supplied by a clock generator TG with the shift pulses for disseminating the information supplied by the keyboard M during the individual interrogation cycles. The shift register PSW preferably had n register cells, so that a respective register cell is permanently assigned to each control input $E_\nu$ and respective control input $E_\nu$ of the shift register PSW to each register cell.

The data output DA of this shift register PSW is connnected to the data input DE of a so-called channel selector KW, which simultaneously forms an information input of a switching system VM. As a further information input, the switching system VM includes the counting input of a tone address counter TAZ which is formed as a binary-base digital counter, the specific construction and drive of which will be described hereinafter in further detail.

In addition to the channel selector KW and the tone address counter TAZ, the switching system VM includes p identical output parts i.e. output channels $V_1$ to $V_p$, wherein $p=10$ in the illustrated embodiment which are controlled, on the one hand, by the channel selector KW and, on the other hand, by the tone address counter TAZ. In addition, the switching system VM has m audio signal inputs, wherein $m=10$ in the illustrated embodiment which are addressed by an audio frequency generator TOS.

The audio frequency generator TOS is of conventional construction and has a number of audio frequency outputs, to each of which an audio frequency is assigned. The audio frequency generator TOS usually has twelve audio frequency outputs, each of which makes available a periodic squarewave which is associated with a respective tone of the highest octave of the range of the organ. Such an audio frequency generator has at the core thereof a squarewave oscillator which provides a squarewave with a sufficiently high frequency to derive therefrom squarewaves with frequencies corresponding to the tones of the highest octave through the aid of frequency dividers. These latter squarewaves are then made available at each of the $m=12$ audio frequency outputs, respectively, of the audio frequency generator TOS.

Correspondingly, m audio signal inputs TSE of the switching system VM, of which only one is shown in FIG. 1, are available to the m audio frequency outputs of the audio frequency generator TOS. For the case $m=12$, twelve such inputs TSE are therefore provided, each of which is assigned to a respective audio frequency of the highest octave.

The individual audio frequency inputs TSE of the switching system VM are connected within the latter to a respective input (identified in like manner) of each of the mutually identical output channels $V_1, V_2, \ldots V_p$, respectively. Each of these output channels $V_1$ to $V_p$ is provided with means for affording a reduction of the squarewaves delivered by the audio frequency generator TOS to the frequencies of the corresponding tones in the lower octaves. These output channels $V_1$ to $V_p$ are, furthermore, respectively provided with an audio signal output $AU_1, AU_2 \ldots AU_p$, from which audio signals selected via the keyboard M pass to the respective amplitude formers or controllers $AF_1, AF_2 \ldots AF_p$ connected thereto. The outputs of the individual amplitude formers or controllers $AF_1, AF_2 \ldots AF_p$, respectively, are provided, for example, in the manner shown in FIG. 4, for driving a common electro-acoustic transducer i.e. a loudspeaker system.

It should further be noted that each of the mutually identical output channels $V_1, V_2 \ldots V_p$, respectively, has a further output $B_1, B_2 \ldots B_p$, respectively, via which, on the one hand, a feedback to the channel selector KW and, on the other hand, an additional control of the respective corresponding amplitude former or controller $AF_1, AF_2 \ldots AF_p$, are provided.

The tone address counter TAZ is formed of two parts. The first part is made up of four flipflop cells connected in series in a conventional manner, for example, of toggle flipflops, each of which represents a binary counting stage. The counting stages are connected in such a manner that the first part of the counter counts up to "12" and then, upon arrival of the thirteenth counting pulse is already reset to the starting state "0". Simultaneously with the arrival of the thirteenth counting pulse (and only for every thirteenth counting pulse), a counting pulse is delivered to the second part of the tone address counter TAZ. The second part of the tone address counter TAZ is formed of three series-connected flipflop cells and, therefore, of three counting stages. They are connected so that the highest count corresponds to the number p of octaves provided overall and is, therefore, preferably equal to "6" or "7".

The just mentioned behavior of the tone address counter TAZ is obtained in the easiest manner if those outputs of the four flipflop cells forming the first part of the counter, which show a "1" for the desired highest counter reading, are each connected to a respective input of an AND gate with four inputs, so that a "1" likewise appears at the output of the AND gate when the highest count is reached. This "1" is then fed to the reset input of the first part of the tone address counter TAZ and to the counting input of the second part of the tone address counter. It is evident that the individual counting stages of the first part of the counter TAZ are devoted to the individual tones within the individual octaves and the individual counting states of the second part to a respective octave within the playing range of the organ.

The parallel-series shift register PSW can, for example, be formed likewise of master-slave flipflop cells controlled by a common shift pulse T or TM, respectively, or even better, of so-called quasistatic shift register cells. As mentioned hereinbefore, the total number of register cells corresponds to the number of keys in the keyboard M. Each register cell has its own information input which is connected via a respective clock-controlled transfer gate to the control input $E_v$ of the digital semiconductor circuit, which is assigned to the respective register cell, and which is addressed by respective logical information from the keyboard M. The totality of the mentioned transfer gates is controlled by a transfer pulse UE, which is likewise provided by the clock generator TG which delivers the shift pulses T and, therewith, the counting pulses for the counter TAZ. With respect to an advantageous construction of the shift register PSW, reference can be made, for example, to U.S. Pat. No. 4,337,526, with respect to an advantageous construction of the clock generator TG, to German Published Non-Prosecuted Application No. 27 13 319 or U.S. Pat. Nos. 4,283,639, 4,291,240 and 4,293,780.

If an arbitrary key of the keyboard M is then depressed, a "1" appears at the control input $E_v$ of the digital semiconductor circuit assigned thereto, the "1" being then stored in the register cell of the shift register PSW assigned to this control input as a consequence of the next transfer pulse. The then following shift pulses T ensure that the shift register PSW is emptied by the next transfer clock pulse UE. The information stored in the individual register cells passes successively through the information output D of the shift register PSW so as to be introduced into the channel selector, which is described in detail hereinafter. The shift pulses T to be supplied for this purpose, are evaluated also via the address counter TAZ in a manner yet to be described hereinafter.

Figure 2:
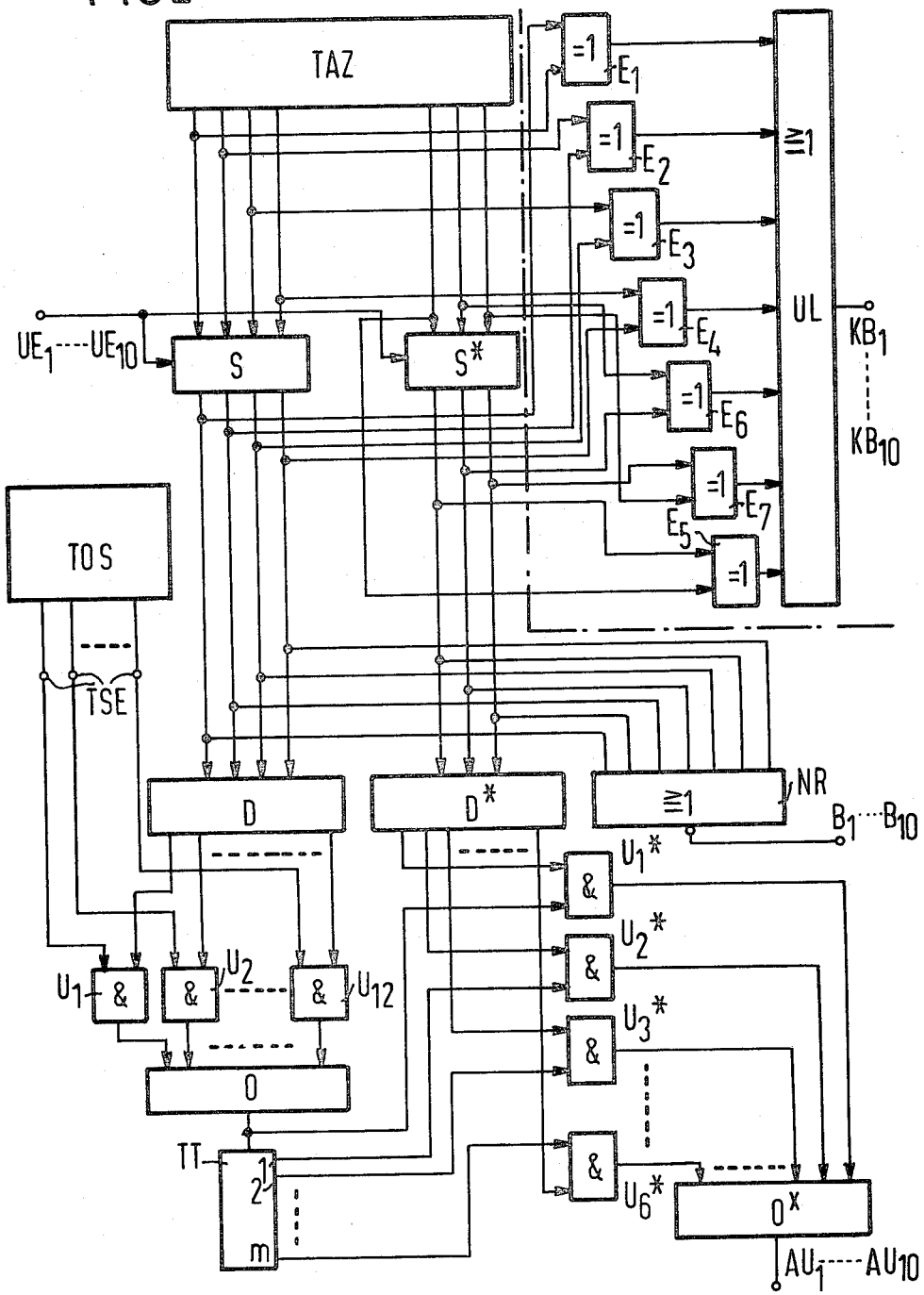
FIGS. 2 to 10 are block diagrams of various details of the switching system and the amplitude formation system, respectively, of FIG. 1.

To this end, the construction of the individual output parts $V_1$, $V_2$, . . . and $V_p$, respectively, which is shown in FIG. 2, will now be discussed initially.

A write-read memory forms an essential part of each of these output parts of the switching system VM. Like the address counter TAZ, this memory is also formed of two parts, namely, a part S and a part S*. The first part S receives its information based upon the part of the address counter TAZ assigned to the individual tone designations; the second memory part S*, on the other hand, is supplied with information to be stored based upon the action of the second part of the tone address counter TAZ which is assigned to the octaves.

The information read-out of the first memory part S is delivered via a first decoder D to twelve AND gates $U_1$ to $U_{12}$ which are addressed simultaneously by the totality of the audio frequency inputs TSE, while the information obtained from the second memory part S* is provided for addressing a second decoder D*. In addition, the information issuing from the two memory parts S and S* serves for controlling a NOR gate NR which, in turn, forms the "feedback" input $B_1$, $B_2$, . . . and $B_p$, respectively, of the output part $V_1$, $V_2$ and so forth, respectively, mentioned hereinbefore in the description of FIG. 1.

Immediately after each transfer pulse UE effecting the entry of the information into the input shift register PSW, the serial readout of the respectively stored information from this shift register PSW and the build-up of the information concerning the two memory parts S and S* sets-in in a manner yet to be described hereinafter. Each of the two memory parts S and S* is advantageously constructed of discrete memory cells, especially of discrete quasistatic register cells corresponding to the input shift register PSW, the clock pulses TM for the input shift register PSW and the counting pulses for the tone address counter TAZ, respectively, being utilized as shift pulses for building up the memory content of both memory parts S and S*, as is further explained hereinafter in connection with FIG. 3.

The data output DA of the input shift register PSW can be connected for this purpose, for example, to the one input of an AND gate, the other input of which is controlled by the shift pulse T or by secondary pulses derived therefrom. The output of this AND gate furnishes a "1" only if a "1" passes the data output DA of the input shift register PSW. The bits which appear at the output of the AND gate and are assigned to the individual shift clock pulses reach the information input of the first memory part S as well as the information input of the second memory part S*. Through the action of pulse sequences derived from the shift pulses or in some other way, the "1" is received in the first memory part S in the memory cell assigned to the point corresponding to the respective tone played within the octave and, in the second memory part S* in the memory cell assigned to the octave containing the tone played. The respectively stored content of the two memory parts S and S* is cleared by a common residual pulse which is advantageously identical with the transfer pulses UE controlling the entry of the information into the input shift register PSW. Further details regarding the feeding-in of the information to the two memory parts S and S* of the individual output parts $V_1$ . . . $V_p$ are provided hereinafter in connection with the description of FIG. 3.

A decoder D and D*, respectively, is associated with each of the two memory parts S and S*.

The first memory part S serving for storing the 4-bit word forming the tone address within the individual octave is accordingly, made up of four individual shift register cells which are evaluated in parallel operation via a decoder D, a "one-out-of-twelve" decoder. With the first decoder D which has twelve signal outputs corresponding to the 12 tone designations c, c-sharp, d, d-sharp, and so forth, there is accordingly associated a respective AND gate $U_1$, $U_2$ . . . and $U_{12}$ per signal output. Each of these AND gates has two inputs. The second input is connected, respectively, to one of the twelve audio signal inputs TSE in the mamner indicated hereinbefore, each of the latter, in turn, being addressed by a respective one of the twelve audio frequency outputs of the audio frequency generator TOS and thus, by a respective one of the audio frequencies of the highest octave. The output of each of the AND gates $U_1$ to $U_{12}$ is connected to a respective output of a common OR gate O.

With respect to the operation of the part of FIG. 2 described heretofore, it should be noted that, due to the respective content of the first memory part S, one of the twelve outputs of the decoder D receives a "1", whereas the others retain a "0". Accordingly, there appears at the output of the hereinaforementioned OR gate O, the audio frequency from the highest octave which is supplied by the tone generator TOS via the audio signal input TSE assigned to the respective decoder output.

The second memory part S* is addressed by a 3-bit word forming the address of the octave selected via the operated or actuated key and likewise controls a decoder D* in parallel operation. This decoder is constructed as a "one-out-of-six" decoder and has, accordingly six signal outputs of which only one receives the level "1" due to the information stored in the memory part S*.

In general, it can be said regarding the construction of the second memory part S*, for an arbitrary number q of octaves provided in the keyboard, that the second memory part S* then has q memory cells i.e. shift register cells which are intended for driving the decoder D* constructed as a "one-out-of-q" decoder, and that then this decoder D* controls q of the AND gates $U^*_1$ to $U_o^*$.

In the case of the example shown in FIG. 2, a total of six octaves is provided in the keyboard M, so that the memory part S* has only three information outputs leading to the decoder D*, and the latter is constructed as a "one-out-of-six" decoder.

With each of the q outputs of the second decoder D*, one of q AND gates $U^*_1$, $U^*_2$, . . . $U^*_o$ is associated, in that the respective decoder output is connected to one of the two inputs of the AND gates $U^*_1$ to $U^*_o$ associated therewith, while the other input of the respective AND gate is addressed via a frequency divider TT controlled via the first OR gate O which is, in turn, controlled by the first decoder D and the audio generator TAZ. The totality of the AND gates $U^*_1$ to $U^*_o$ addressed by the second decoder D* is connected with the signal outputs thereof to an input each of a second OR gate O*, the signal output of which forms the tone signal output $AU_1$, $AU_2$, . . . and $AU_p$, respectively, if the output part of the switching system VM under consideration is the first output part $V_1$ or the second output part $V_2$ or the last output part $V_p$ thereof, respectively.

The frequency divider TT controlled by the first OR gate O is referred to hereinafter as the tone divider since its purpose is to generate, from the tone signals belonging to the tones of the highest octave and delivered by the tone generator TOS, audio oscillations intended for the output $AU_1$, and $AU_2$, . . . and $AU_p$, respectively, by frequency division.

Each of the AND gates $U^*_1$ to $U^*_o$ (i.e., in the case of the example, $U^*_1$ to $U^*_6$) controlled by the second decoder D* is controlled at the second input thereof via the first OR gate and, more specifically, in the following manner: The output of the first OR gate is connected not only to the input of the tone divider TT but also to the second input of the first of the aforementioned AND gates $U^*_1$. The signal output of the first divider stage of the tone divider TT is connected to the second input of the second AND gate $U^*_2$, the signal output of the second divider stage to the second input of the third AND gate $U^*_3$, and so forth, so that the (q-1)th divider output i.e., in the example of FIG. 2, the fifth divider output, is connected to the second input of the last (=qth) of these AND gates i.e., in the case of the example, to the second input of the AND gate $U^*_6$. Thereby, each of the AD gates $U^*_1$ to $U^*_2$ controlled by the second decoder D* is associated with a respective one of the octaves provided in the keyboard M.

Consequently, the respective tone selected based upon the respective content of the first memory part S via the decoder D is fed as the tone of the highest octave to the AND gate $U^*_1$ and to the tone divider TT. Due to the address of the octave selected via the keyboard M, which address is stored in the second memory part S*, only one of the AND gates $U^*_1$to $U^*_q$ i.e., in the case of the example, $U^*_1$ to $U^*_6$, is activated at any one time so that, upon activation of the AND gate $U^*_1$, the selected tone of the highest octave is fed to the second OR gate O*, upon activation of the AND gate $U^*_2$, the selected tone of the second-highest octave, and upon activation of the AND gate $U^*_o$, the selected tone from the lowest octave, and thereby to the signal output AU of the respective output channel, if the latter were selected by the channel selector KW by a corresponding signal via the control input $UE_1$, $UE_2$, . . . and $UE_p$, respectively, thereof.

For the feedback control to the channel selector KW as well as for influencing the amplitude formers $AF_1$ to $AF_p$ connected to the output parts $V_1$ to $V_p$ under consideration, signals that are to be fed to a control input $B_1$, $B_2$, . . . and $B_p$, respectively, are required, as was indicated hereinbefore in FIG. 1. To obtain the latter, each input of the two decoders D and D* controlled by the two memory parts S and S* is connected to a respective input of a NOR gate NR which delivers a signal via the feedback input $B_1$, $B_2$, and so forth, respectively, only if the two memory parts S and S* of the output channel $V_1$, $V_2$, and so forth, respectively, under consideration, are empty.

Furthermore, a comparison between the signal input and the signal output of each of the memory cells of the two memory parts of the individual output channel $V_1$ to $V_p$ is provided. This can be accomplished, for example, via a respective equivalence gate $E_1$, $E_2$, . . . $E_p$ ($E_{10}$ in the case of the example), the outputs of which are connected to a respective input of an AND gate UL with p inputs (thus, with ten inputs in the case of the example). The totality of these equivalence gates and the AND gate forms a respective comparator $K_1$, $K_2$, and so forth. A "1" at the output of the AND gate UL indicates that the tone address stored in the respective output channel $V_1$ to $V_p$ is equal to the count of the tone address counter TAZ.

Instead of the just-described construction of the individual comparators $K_1$ to $K_p$ by means of equivalence gates, the gates $E_1$ to $E_p$ can all also be Exclusive-OR gates. However, the AND gate UL must then be replaced by a corresponding NOR gate.

As further considerations will yet indicate, the comparators $K_1$ to $K_p$ have several purposes. One of the purposes is to indicate that the respective output channel $V_1$ to $V_p$ is occupied. A common purpose of these comparators, moreover, is to control the channel selector KW. This is done with the aid of an OR gate OD*, as is evident from FIG. 3.

Figure 3:
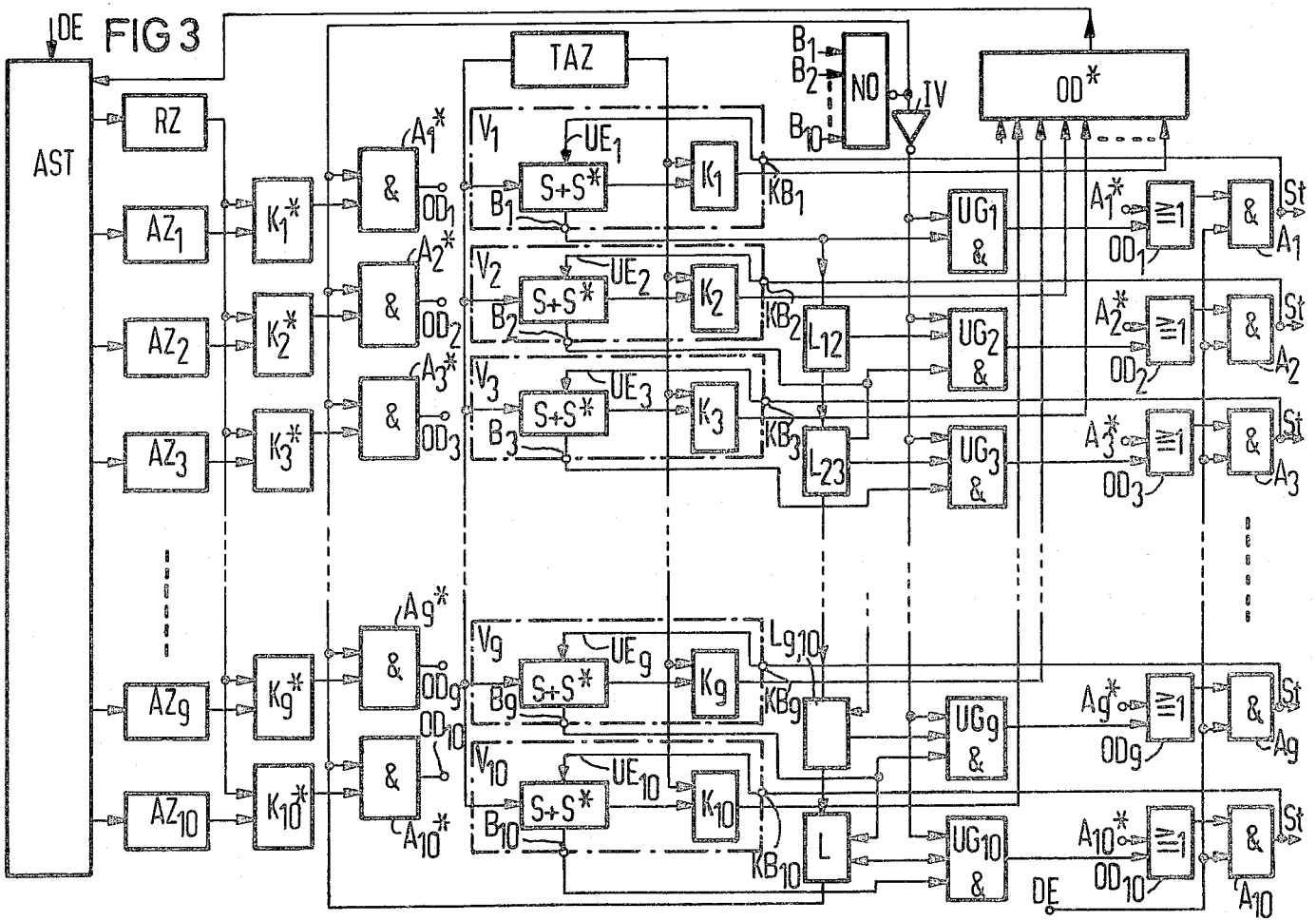

The various functions which must be performed by the switching system VM are primarily controlled via the channel selector KW. The block diagram of a preferred embodiment of the channel selector KW is shown in FIG. 3.

Of the embodiment of the switching circuit shown in FIG. 2 and the overall circuit given in FIG. 1, the tone address counter TAZ and the address memory parts S, S* of the individual output parts $V_1$, $V_2$, . . . and $V_p$, respectively, in the case of the example, p=10, as already indicated hereinbefore, are indicated as well as the comparators $K_1$ to $K_p$ provided by the equivalence gates $E_1$ to $E_7$ and the OR gate OR controlled by the latter, since the comparators $K_1$ to $K_p$ are, on the one hand, subjected directly to the control action by the channel selector KW and in turn have reactions on the channel selector.

With each of the provided output channels $V_1$ to $V_p$ an AND gate $A_1$, $A_2$, . . . and $A_p$, respectively, is provided in the channel selector KW (in the case of the example, $A_1$ to $A_{10}$). Each of these AND gates $A_1$ to $A_p$ is controlled via two inputs, of which, respectively, the one is connected to the data input DE of the channel selector controlled by the input shift register PSW, and the other, to the output of a respective OR gate $OD_1$, $OD_2$, . . . and $OD_p$. The signal output of each of these AND gates $A_1$ to $A_p$ forms the corresponding control output $UE_1$, $UE_2$ . . . and $UE_p$, respectively, which serves for the additional control of the address memory S and S* belonging to the respective output part $V_1$, $V_2$, . . . and $V_p$ associated with the switching systems VM, and which will be discussed hereinafter in detail.

The OR gate $OD_1$, $OD_2$, . . . and $OD_p$, respectively, controlling the just-mentioned individual respective AND gates $A_1$ to $A_p$ has a first input which is directly addressed, respectively, by the output of a respective further AND gate $UG_1$, $UG_2$, . . . $UG_p$. A second signal input of each of these OR gates $OD_1$ to $OD_p$ is controlled by the signal output of a respective further AND gate $A^*_1$ to $A^*_p$.

The AND gates $UG_1$ to $UG_p$ mentioned in connection with the control of the OR gates $OD_1$ to $OD_p$ have three inputs, with the exception of the AND gate $UG_1$ which is associated with the first output part or channel $V_1$, while the AND gate associated with the first channel $V_1$ has only two inputs. A respective one of the inputs of all these AND gates $UG_1$ to $UG_p$ is controlled by the control output $B_1$, $B_2$, . . . $B_p$, respectively, (provided by the NOR gate NR) of the respective output part or channel $V_1$, $V_2$, . . . $V_p$, respectively, while another input of each of these AND gates is controlled via an inverter IV by a common NOR gate NO. A respective input of the previously mentioned further AND gates $A^*_1$ to $A^*_p$ is connected directly to the output of this NOR gate NO, the inputs of which are addressed by a respective one of the provided total number of the output parts $V_1$ to $V_p$ of the switching system VM via the control output $B_1$ to $B_p$ of the latter.

The AND gate $UG_1$ associated with the first output part $V_1$ is therefore fully driven by the control output $B_1$ and by the NOR gate NO. In the remaining AND gates from the group of the AND gates $UG_1$ to $UG_p$, there are three inputs, as just stated above, two of which are controlled in an analogous manner to that of the two inputs of the first $UG_1$ of these AND gates. Accordingly, one input, respectively, of all these AND gates $UG_2$ to $UG_p$ is connected to the output of the NOR gate NO via the inverter IV, and a second input to the control output $B_2$, $B_3$, . . . and $B_p$, respectively, of the respective output part $V_2$, $V_3$, . . . $V_p$ of the switching system VM. The third input of these AND gates $UG_2$ to $UG_p$ is controlled via the output of a respective logic cell $L_{12}$, $L_{23}$, . . . $L_{(p-2)}$, P.

The logic cell $L_{12}$ is provided for controlling the third input of the second AND gate $UG_2$ of the series of AND gates $UG_1$ to $UG_p$, is formed merely of an inverter, the input of which is controlled by the control output $B_1$ of the first output part $V_1$ of the switching system VM (which is connected simultaneously to the one input of the AND gate $UG_1$) and the output of which is connected, on the one hand, to the third input of the AND gate $UG_2$ (associated with the second output part $V_2$) and is tied, on the other hand, to the input of the next logic cell $L_{23}$ provided for addressing the following AND gate $UG_3$.

The other logic cells $L_{23}$ to $L_{(p-1),p}$ are mutually identical and are each formed of an inverter $L_{23a}$, $L_{34a}$, . . . $L_{(p-1),p\,a}$, respectively, and a NOR gate with two inputs, the output of which forms the signal output of the respective logic cell and which is identified as $L_{23b}$, $L_{34}$b, . . . $L_{(p-1),p\,b}$, respectively (see FIG. 4). Circuitwise, the input of the inverter a of the respective logic cell $L_{23}$, $L_{34}$, . . . $L_{(p-1),p}$ is connected to the output of the respective preceding logic cell $L_{12}$, $L_{23}$, . . . $L_{(p-2),(p-1)}$, while the output thereof is connected to the one input of the respectively associated NOR gate b. The other input of the NOR gate b of the respective logic cell $L_{23}$ to $L_{(p-1),p}$ is controlled by the respective control output $B_1$, $B_2$, . . . $B_p$ of that output part $V_3$, $V_4$, . . . $V_p$, respectively, with which the respective AND gate from the series of AND gates $UG_1$ to $UG_p$ is associated. The construction and connection of the logic cells is shown in FIG. 4 by the example of the first three of these logic cells, namely the logic cells $L_{12}$, $L_{23}$ and $L_{34}$.

In the channel selector (or output part selector) KW shown in FIG. 3, the output of the NOR gate NO controls not only the just-discussed AND gates $UG_1$ to $UG_p$, but also a further group $A_1^*$ to $A_p^*$ of AND gates, also mentioned hereinbefore, which are likewise assigned to a respective one of the output channels $V_1$ to $V_p$ of the switching system VM. Each of these AND gates $A_1^*$ to $A_p^*$, for example, has two inputs, of which one is connected, without interposition of an inverter or another component, directly to the output of the NOR gate NO, while the other is connected to the output of a comparator $K_1^*$ to $K_p^*$, respectively. The construction of the comparators $K_1^*$ to $K_p^*$ is the same as that of the individual comparators $K_1$ to $K_p$. They are addressed, on the one hand, by a common reference counter RZ and, on the other hand, by respective, so-called age or priority time counters $AZ_1$, $AZ_2$, and so forth, respectively, and respond, when the count of each of the p age or priority time counters $AZ_1$ to $AZ_2$ which are provided and are permanently assigned to a respective one of the p output channels $V_1$ to $V_p$, and the respective count of the reference counter RZ are equal.

Figure 4:
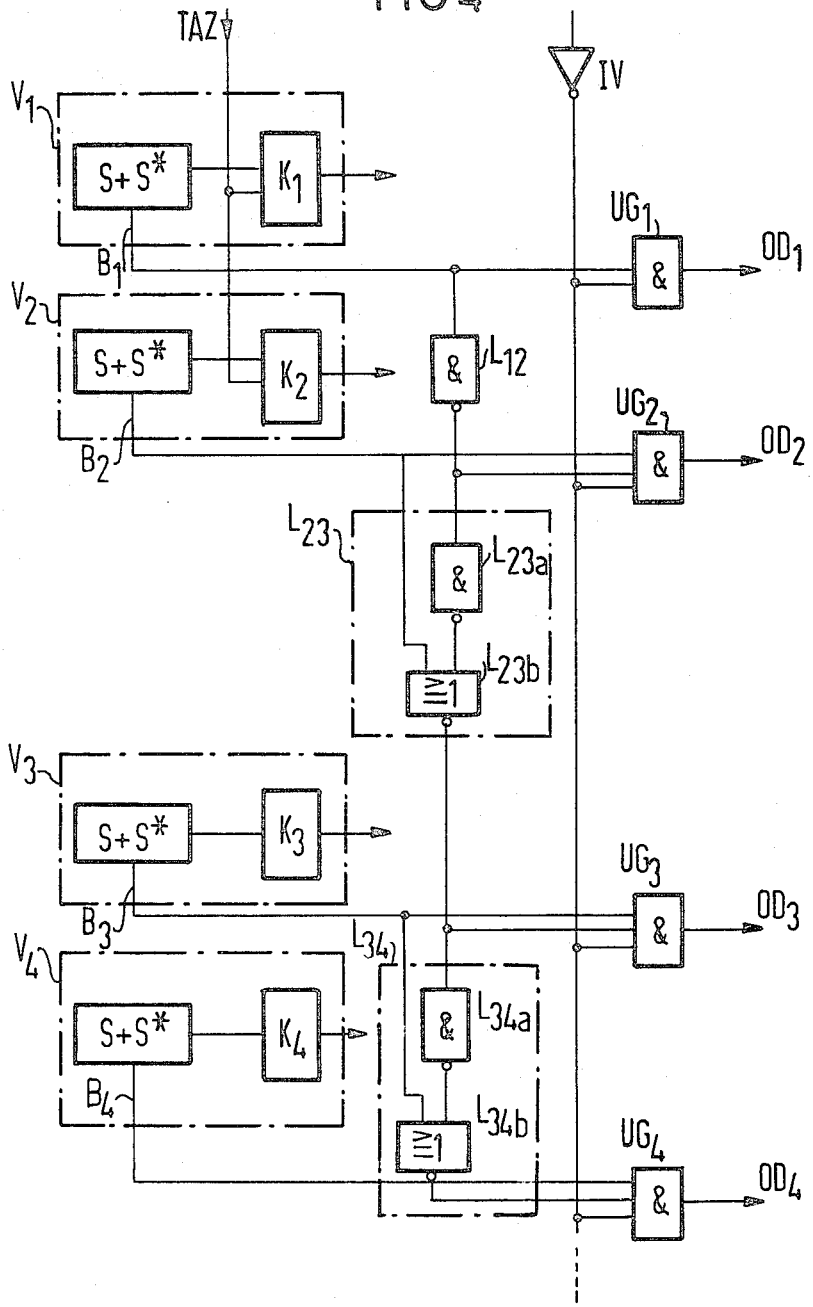

Hereinafter, the operation of the channel selector KW shown in FIGS. 3 and 4 is described. It is advisable, in this connection, to discuss first the construction of the individual memory parts S and S* in the individual output channels $V_1$ to $V_p$. It is recommended that the individual memory cells of these memory parts be formed by quasi-static shift register cells. In constrast with a shift register, however, no series connection of the memory cells is provided here, but each memory cell stands alone on the input side as well as on the output side. Only the addressing via the keyboard M and the clock supply are common.

Figure 5:
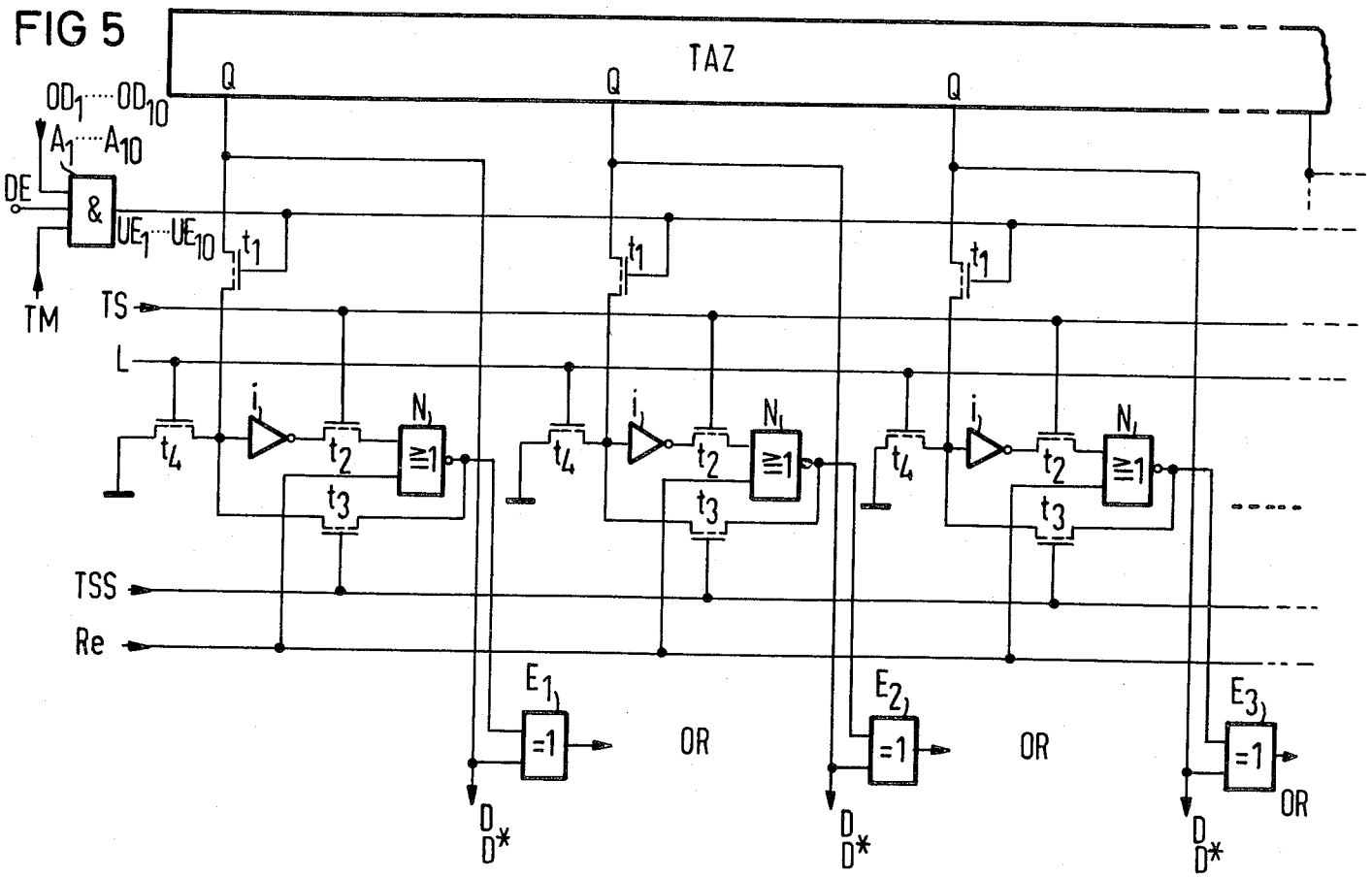

Overall, seven memory cells $S_1$ to $S_4$ and $S_1^*$ to $S_3^*$ are assigned to each of the output parts $V_1$ to $V_p$, the four cells $S_1$ to $S_4$ being controlled by the first part of the tone address counter TAZ and the three cells $S_1^*$ to $S_3^*$ by the second part of the tone address counter TAZ. Accordingly, the memory cells of the first memory part S are intended for storing the designation of the respective played tone within the individual octave, and the memory cells of the second memory part for storing the designation of the octave in which the respective tone played or to be played is located. Accordingly, the signal outputs of the memory cells $S_1$ to $S_4$ forming the first memory part S are further provided for addressing the first decoder D and the outputs of the memory cells $S_1$* to $S_3$* forming the second memory part S* for controlling the second decoder D*. In FIG. 5, which will be discussed before the further description of a channel selector KW according to FIG. 3 is continued, only the first three memory cells $S_1$ to $S_3$ of the first memory part S are shown. Construction and connection of the remaining memory cells $S_4$ and $S_1$* to $S_3$*, respectively, fully correspond to that of the memory cells shown in FIG. 5.

Each of the memory cells of the two memory parts S and S* in each output channel $V_1$ to $V_p$ contains four transfer transistors $t_1$, $t_2$, $t_3$ and $t_4$, each of which is realized by an MOS transistor of the enhancement type. It further contains an inverter i and a NOR gate N. Moreover, a so-called three-phase clock is required i.e. a clock TG which is capable of delivering three periodic pulse sequences TM, TS and TSS having the same frequency. It is essential for the three pulse sequences that the individual pulses TS be inserted without overlap between two respective pulses of the sequence TM, so that an interval is provided between respective adjacent pulses TM and TS. In addition, the falling flanks of the pulses from the sequence TSS coincide with the falling flank of a respective pulse from the sequence TS while, with respect to the rising flank, the pulses TSS are slightly delayed relative to the pulses TS. Since the input shift register PSW is advantageously also constructed with quasi-static register cells i.e. with cells corresponding to those of FIG. 5, clock pulses TM, TS and TSS are needed there also. Finally, the individual counter stages of the tone address counter TAZ and other counters used in the circuit, especially also the reference counter RZ and the age counters $AZ_1$ to $AZ_p$, will also be constructed by means of master-slave flip-flops (especially by means of a respective toggle flip-flop), for the operation of which the pulses TM and TS are also required.

The data input of each of the memory cells forming the memory parts S and S* is formed, as is apparent from FIG. 5, by the source terminal of the transfer transistor $t_1$, which is accordingly connected to the counting output Q of the respective counter stage of the tone address counter TAZ assigned thereto. The gates of the input transfer transistors $t_1$ of all of these memory cells $S_1$ to $S_4$ and $S_1$* to $S_4$* are connected together to the output of the and gate $A_1$, $A_2$ . . . $A_p$ assigned to the output of the respective output channel $V_1$ to $V_p$ and forming channel selector output $UE_1$, $UE_2$ . . . $UE_p$, respectively controlling the latter. If the memory cells shown in FIG. 5 are used, the AND gates $A_1$ to $A_p$ must each be equipped with three signal inputs. Two thereof are addressed in the manner evident from FIG. 3, while the third one is controlled by the clock pulses TM which control the memory cells $S_1$, $S_2$ and so forth.

The drain of the transistor $t_1$ of each of these memory cells $S_1$, $S_2$ and so forth is connected, on the one hand, to an inverter i and on the other hand, to a respective current-carrying electrode of two transfer transistors $t_3$ and $t_4$. The output of the inverter is connected via a transfer transistor $t_2$ to the one input of a NOR gate N, the second input of which is controlled by a general reset signal Re, the NOR gate having an output which forms the output of the respective memory cell. The gates of the transfer transistors $t_2$ of the memory cells are jointly controlled by the clock pulses TS.

The transfer transistors $t_4$ bridge, with the source-drain path thereof, the series circuit formed of the inverter i, the transfer transistor $t_2$ and the NOR gate N. The gate thereof is controlled by the clock pulses TSS. The transfer transistor $t_4$ is connected, with the source-drain path thereof, between the reference potential (ground) and the input of the inverter i. The gate of the transfer transistor $t_4$ is driven by pulses L generated in a manner to be described hereinafter. The output of the NOR gates N of each of the memory cells $S_1$, $S_2$ and so forth is connected, on the one hand, to the input of one of the two decoders D and D* assigned thereto. On the other hand, to each of the seven memory cells a respective one of the comparator gates $E_1$ to $E_7$ of the comparator $K_1$, $K_2$ and so forth, respectively, is assigned. To this end, the one input of the respective equivalence gates $E_1$, $E_2$, . . . $E_7$, respectively, of the respective comparator $K_1$, $K_2$, . . . $K_p$ is connected to the source terminal of the input transfer transistor $t_1$, and the other input to the output of the NOR gate N of the respective memory cell. It should be noted that the clearing pulses L which control the gate of the transistors $t_4$ are provided by pulses selected from the sequence TM. The generation thereof will be taken up hereinafter.

The "1" which, upon activation of the input transfer transistor $t_1$ associated with the individual memory cells in the memory parts S and S* of the individual output channel $V_1$ to $V_p$, arrives at the source of the input transfer transistor $t_1$ is kept in the respective memory cell due to the two pulse sequences TS and TSS until the "1" is cleared via the clearing transistor $t_4$ by a clearing pulse L, and the memory cell is again available for writing a "1". Since the clearing pulse L arrives simultaneously at all the clearing transistors $t_4$ of the memory cells $S_1$, $S_2$ and so forth belonging to the respective output channel $K_1$ to $K_p$, the two memory parts S and S* of the respective output channel are cleared simultaneously, so that the channel is again available for being acted upon by the tone address counter TAZ. This is indicated by the "1" at the reset control output $S_1$, $S_2$ and so forth of the respective channel $V_1$, $V_2$, . . .

In summary, the following can therefore be stated:

1. Every time the counter reading which is stored in the two memory parts S and S* of each output channel $V_1$ to $V_p$ is reached by the outputs of the counting stages in the tone address counter TAZ, a "1" appears at the output of the comparator $K_1$, $K_2$ and so forth assigned to the respective output channel $V_1$, $V_2$, and so forth. This applies also if the count of the tone address counter TAZ is equal to "0" and the respective memory parts S and S* are empty. In all other cases, a "0" is present at the outputs of the individual comparators $K_1$ to $K_p$.

If the overall arrangement is then activated, provision is made by means of a general resetting signal that all output channels $V_1$ to $V_p$, the age counters $AZ_1$ to $AZ_p$ assigned thereto and the reference counter RZ are in the starting condition, so that a "1" is provided at the output of all of the comparators $K_1$ to $K_p$ and $K_1$* to $K_p$*.

If a key on the keyboard M is then struck, a "1" is entered in the register cell of the input shift register PSW assigned thereto, while the register cells assigned to the non-operated keys remain in the state "0". The clock pulses then setting-in begin to shift the "1", which is generated due to the pressed key, out of the input shift register, each shifting pulse being counted in the tone address counter TAZ. Since the arrangement of the individual register cells in the input shift register PSW corresponds exactly to the arrangement of the keys on the keyboard M, the number of the shifting pulses required until the "1" appears at the data output of the input shift register PSW, and the counter reading in the tone address counter TAZ built up with the aid thereof is the address for the respective played tone.

To transfer the count forming this address from the tone address counter TAZ into one of the output channels $V_1$ to $V_p$, each of the inputs at one of the AND gates $A_1$ to $A_p$ must be occupied by a "1". Since the information is shifted out of the input shift register PSW by the clock pulses TM, TS and TSS delivered by the clock generator TG also if the shift register cells are quasistatic register cells, provision is made automatically that, which a "1" arrives via the data input DE of the channel selector KW at the input of the AND gates $A_1$ to $A_p$, a "1" is also present at the input devoted to the clock pulse TM of these AND gates. Since, finally, of all these AND gates $UG_1$ to $UG_p$, and AND gate $UG_1$ has only two inputs, and one input of all of these AND gates, if the memories are empty, is continuously addressed by a "1" via the corresponding resetting output $B_1$, $B_2$, . . . $B_p$, respectively, and furthermore, the "1" supplied by the inverter IV is present at the second input of all the AND gates $UG_1$ to $UG_p$, and only the AND gate $UG_1$ which is assigned to the first output channel $V_1$ has only two inputs, a "1" will appear only at the output of this AND gate $UG_1$. This means that, of the OR gates $OD_1$ to $OD_p$, only the OR gate $OD_1$ has a "1" at the output. Thus, only the AND gate $A_1$ associated with the first output channel $V_1$ can respond, when the "1" leaves the input shift register PSW, and activate the output channel thereof.

This means that the counter reading present when the "1" emerges from the input shift register PSW i.e. the address of the played tone is transferred into the memory cells of the first output channel $V_1$. As a result, the "0" at the output of the comparator $K_1$ disappears; furthermore, a "0" appears at the resetting output $B_1$ of the first output part $V_1$ instead of the "1" present until then; and, thereby, all three inputs are occupied by a "1" at the AND gate $UG_2$ associated with the second output channel $V_2$. A "1" is produced at the output of the logic cell $L_{12}$ (represented only by an inverter) due to the "0" at the resetting output $B_1$, so that a "1" is then present at the output of $UG_2$, while the "1" at the output of the AND gate $UG_1$ has then disappeared and a "1" is likewise precluded, for the time being, at the outputs of the other AND gates $UG_3$ to $UG_p$.

Thus, the counter reading of the tone address counter TAZ built up until then and, thereby, the tone address of the new played tone is transferred to the memory cells of the second output part $V_2$ when the next "1" is shifted out of the input shift register PSW. Thereby, the "1" at the resetting output $B_2$ of this channel $V_2$ disappears, provision being made via the logic cell $L_{23}$ that the three inputs of the AND gate $UG_3$ belonging to the next output channel $V_3$ remain addressed by a "1" until the next "1" arrives from the input shift register PSW. The cycle is repeated successively at the respectively following output channels $V_4$ to $V_p$ until the addresses of the first p tones played are stored in a respective one of the output channels and provision is made in the manner hereinafore described in connection with FIG. 2 that, as long as the storage state persists, the audio frequency oscillation corresponding to the stored tone is delivered at the tone signal output $AU_1$, $AU_2$, . . . $AU_p$, respectively, of the corresponding output channel $V_1$, $V_2$, . . . $V_p$ to the respective associated amplitude former $AF_1$ to $AF_p$.

If all of the channels $V_1$ to $V_2$ are then occupied by a played tone, provision must be made that the memory cells of at least one of the output channels $V_1$ to $V_p$ be emptied again by an L-pulse. The generation of these clearing pulses representing branched-off TM pulses as well as the distribution or apportionment thereof to the individual output parts $V_1$ to $V_p$ of the switching system VM then depends upon various previously mentioned aspects. How the realization is accomplished in individual cases will be shown after a discussion of FIGS. 6 and 7.

Figure 6:
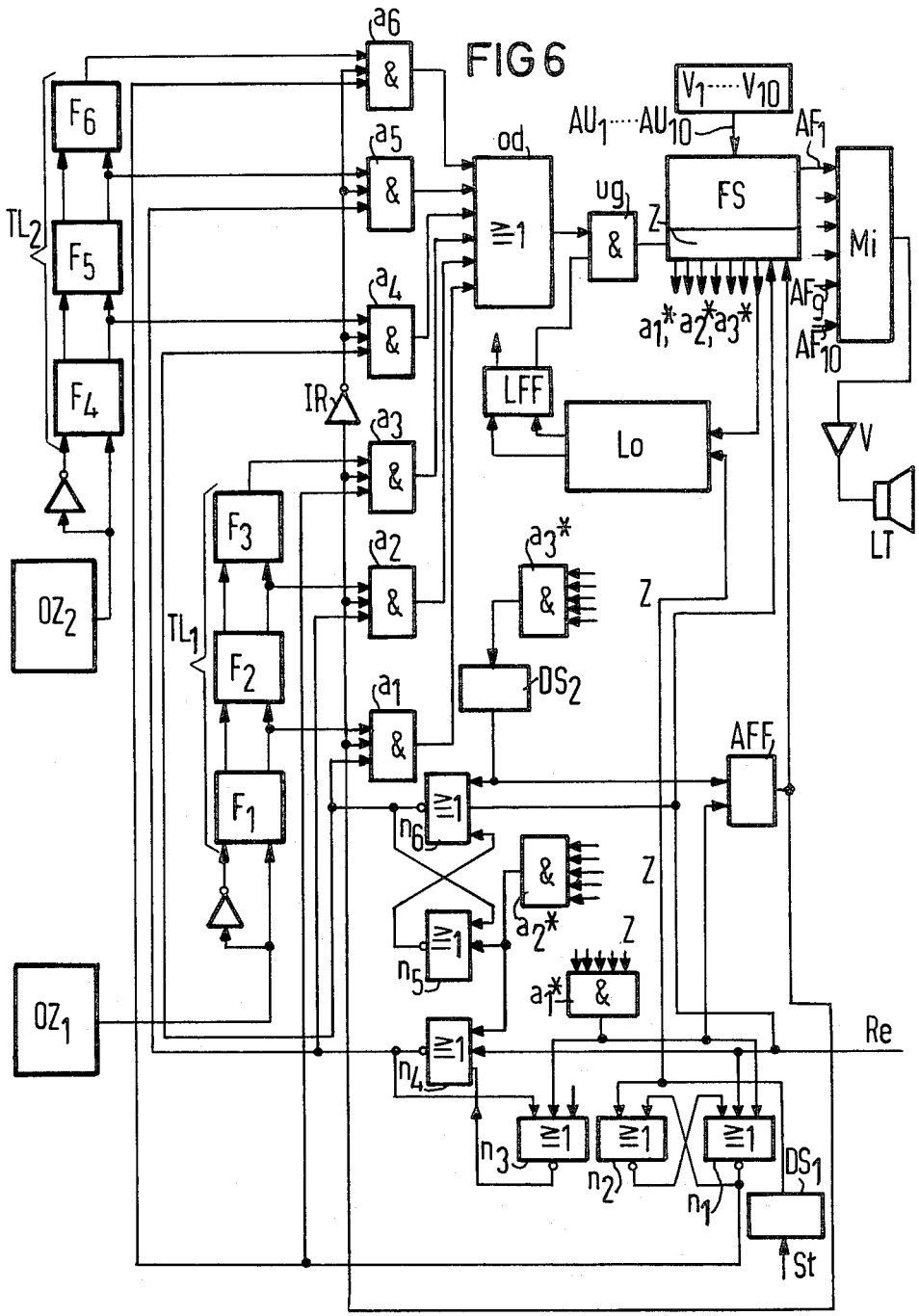

The output of each of the output channels $V_1$ to $V_p$, respectively, shown in FIG. 2 of the switching system VM controls a respective amplitude former $AF_1$ to $AF_p$. The construction of such an amplitude former is shown in FIG. 6.

In accordance therewith, the output $AU_1$, $AU_2$, . . . $AU_p$, respectively, of the respective output part $V_1$ to $V_p$ is connected to the input of a former circuit FS, which is always combined with a counter Z. Regarding the details of the former circuit FS and the counter Z, reference can be made to U.S. patent application, Ser. No. 137,420, filed Apr. 4, 1980 assigned to the assignee of the instant application. This Patent Application concerns a semiconductor circuit for transforming sequences of periodic a-c voltage signals with a signal input, a circuit part effecting the transformation, and a signal output. Characteristic of this semiconductor circuit is the measure that the signal input E is connected to the one current-carrying terminal of n identical transistors and each of these n transistors is combined with another such transistor to form a respective transistor pair, in that the other current-carrying terminal of the first transistor of each transistor pair is connected to the corresponding current-carrying terminal of the associated further transistor and, in addition, is connected via one of n different resistor combinations, to the signal output A of the circuit; furthermore, the resistor combinations assigned to the individual transistor pairs form a resistance network; and the first current-carrying electrodes of the second transistors of all these transistor pairs are connected to a common supply potential which is different from the reference potential ground; and, finally, for addressing the control electrodes of the transistors, a digital counter Zä is provided which has n counting stages and is controlled by counting pulses from a clock generator, and the n transistor pairs are connected to the signal outputs Q, $\overline{Q}$ of the digital counter Z in a manner which differs from case to case.

The binary counters Z which are assigned to the individual amplitude formers $AF_1$ to $AF_p$ are constructed as bidirectional counters, as has already been explained in U.S. patent application Ser. No. 137,420. In the case of the example, it has seven counting stages in the form of seven series-connected flipflop cells, for example, toggle flipflop cells, each of which is provided with two inputs i.e. a direct input and an inverted input. Each of the two inputs of the individual flipflop cells forming the counter Z is connected to the gate of a respective MOS transistor of the enhancement type. The drains of the two MOS transistors associated in this manner with a respective counting stage are connected together and are connected, via a respective resistor, to a divider point of a voltage divider realized, in the case of the example, by eight series-connected resistors. The source terminals of that one, respectively, of the two MOS transistors associated with each counting stage is connected to an intermediate operating or supply potential and the other transistor (associated with the inverted input) is connected with its source to the tone signal output $AU_1$ to $AU_p$, respectively, of the output channel $V_1 \ldots V_p$, respectively, associated with the corresponding amplitude former or controller $AF_1 \ldots AF_p$, respectively, of the switching system VM. The stated voltage divider has one end forming the sigal output $SG_1, \ldots, SG_p$, respectively, of the respective amplitude former and is connected by the other end thereof to the intermediate supply potential and, therefore, to the source terminals of the MOS transistors associated with the invertedly addressed inputs of the individual counting stages.

The signal outputs of the p amplitude formers or controllers $AF_1$ to $AF_p$ which are provided are respectively connected to one input, respectively, of a mixing stage Mi, the output of which drives a loudspeaker LT i.e. an electroacoustic transducer, via an amplifier. Details regarding the heretofore described parts of the amplitude former circuit shown in FIG. 6 need not be discussed further in connection with the presently considered semiconductor circuit.

The counting input of the bidirectional counter Z of the amplitude former is supplied from a system containing at least one oscillator for generating the counting pulses, the system in turn being revertively controlled by definite counter readings of the respective counter Z. In the case of the example, two of such oscillators $OZ_1$ and $OZ_2$ are provided which are constructed in a conventional manner so that they deliver squarewaves with adjustable frequency. Each of these two oscillators $OZ_1$ and $OZ_2$ drives a frequency divider $TL_1$ and $TL_2$, respectively, which have, in the case of the example, three series-connected divider stages $F_1$ to $F_3$ and $F_4$ to $F_6$ each in the form of flipflop cells. In the case of the example, master-slave flipflops (toggle flipflops) are used for the individual divider stages, so that the oscillations delivered by the respective oscillator $OZ_1$ and $OZ_2$ are fed directly to the one input of the first flipflop cell and via an inverter (not specifically indicated) to the other input. These two oscillators $OZ_1$ and $OZ_2$ are common to all of the p amplitude formers or controllers provided. They thus control altogether p frequency dividers $TL_1$ and p frequency dividers $TL_2$.

As further components of the system for generating the counting pulses, at least two flipflops and a logic circuit are provided. The logic circuit delivers, as counting pulses for the counter Z, the supply of oscillations provided by the divider stages and is revertively controlled by certain counter readings of the binary counter Z via the flipflops, and is formed of a combination of AND gates and OR gates.

In the example or embodiment of the invention shown in FIG. 6, six AND gates $a_1$ to $a_6$ with three signal inputs each are provided, of which the three first ones are associated with the first divider $TL_1$ controlled by the oscillator $OZ_1$, and the three last ones are associated with the second divider $TL_2$ driven by the oscillator $OZ_2$, inasmuch as one respective output, for example, the noninverted output, of each divider stage $F_1$ to $F_6$ is connected to one respective input of one of the AND gates $a_1$ to $a_6$, respectively. Consequently, for example, the AND gates $a_1$ to $a_3$ are assigned to the first divider $TL_1$ and the AND gates $a_1$ to $a_6$ to the second divider $TL_2$. The outputs of all of these AND gates $a_1$ to $a_6$ go to a respective input of a common OR gate od. The output of this OR gate od is connected to a further AND gate ug which has two inputs, one of which is addressed by the OR gate od and the other by the one output of a flipflop cell LFF. The flipflop LFF is addressed at both inputs thereof by a respective output of the logic circuit Lo. This logic circuit Lo is, in turn, controlled by the bidirectional counter Z and a starting signal St which is furthermore provided for starting the RS flipflops formed by the two NOR gates $n_1$ and $n_2$.

In the case of the example or embodiment of the invention, the bidirectional counter Z has seven counting stages. The counter Z controls the logic circuit Lo with the counter reading "0" as well as with the highest counter reading thereof and, with the highest counter reading as well as with two further counter readings, a respective one of the three AND gates $a_1$*, $a_2$* and $a_3$* (more such AND gates may also be provided, of course), each of which has seven inputs which are addressed, for coding a given counter reading of the counter Z, by a respective one of the two outputs Q and $\overline{Q}$ of each counting stage of Z. The AND gate $a_1$* is associated with a first counter reading different from "0", the AND gate $a_2$* with a second, higher counter reading, and the AND gate $a_3$* with an even higher counter reading of Z, which, especially, corresponds to the highest counter reading of this counter Z. A differentiating stage $DS_2$ is assigned to the output of the third AND gate $a_3$*, while the control of the other two AND gates $a_1$* and $a_2$* operates without such a differentiating stage.

The AND gate $a_1$* is connected to one input of the previously mentioned NOR gate $n_1$ which, together with the NOR gate $n_2$, forms an RS-flipflop. To this end, the output of the NOR gate $n_1$ is connected to one input of the NOR gate $n_2$ and the output of the NOR gate $n_2$ to one input of the NOR gate $n_1$. The first NOR gate $n_1$ also has a third input which is connected to a reset input Re controlled by reset signals of the circuit according to FIG. 6. This reset input Re, if applicable, moreover, drives the reset input of the counter Z, so that the latter is switched to the counter reading "0" upon the arrival of a reset pulse (unless the counter z has been switched beforehand to "0" by the backwards-counting phase). An input St controlled by a start signal is connected, on the one hand, via a differentiating stage $DS_1$ to the logic Lo and, on the other hand, to a second input of the NOR gate $n_2$, which is cross-coupled to the NOR gate $n_1$. The output of the RS-flipflop formed by the NOR gates $n_1$ and $n_2$ is identical with the output of the NOR gate $n_1$. It is connected to a respective input of the AND gates $a_3$ and $a_6$ addressed by the last two divider stages $F_3$ and $F_6$ of the two dividers $TL_1$ and $TL_2$.

A second RS-flipflop is connected by the two NOR gates $N_3$ to the output of the respective other NOR gate. A second input of the NOR gate $n_3$ is connected to the output of the AND gate $a_1$*, a second input of the other NOR gate $n_4$ to the output of the AND gate $a_2$*, and a third input of the NOR gate $n_4$ to the reset input Re of the circuit. The output of the second RS-flipflop $n_3$, $n_4$ is provided by the output of the second of these NOR gates i.e. by the output of the gate $n_4$. The latter output is connected to a respective input of the AND gates $a_2$ and $a_5$, respectively, which are addressed by the two next-to-the-last stages $F_2$ and $F_4$, respectively, of the two dividers $TL_1$ and $TL_2$.

A third RS-flipflop is provided by the two NOR gates $n_5$ and $n_6$, of which again one input each is fed back to the output of the other gate. A further input of the gate $n_5$ is controlled by the output of the second AND gate $a_2$* and a further input of the other NOR gate $n_6$ by the output of the AND gate $a_3$* via a differentiating stage $DS_2$. A third input of the NOR gate $n_6$ is connected to the reset input Re. The output of the NOR gate $n_6$ forms the output of the third RS-flipflop $n_5$, $n_6$ and is connected to a respective input of the AND gates $a_1$ and $a_4$, respectively, which are addressed by the first divider stages $F_1$ and $F_4$.

The output of the differentiating stage $DS_2$ controlled by the AND gate $a_3$* is further connected to the one input of a further flipflop cell AFF, the second input of which is connected to the reset input Re. The output of the flipflop AFF receiving the level "L" when a signal appears at the output of the differentiating stage $DS_2$, is connected to a respective last input of the AND gates $a_1$ to $a_3$ which are controlled by the first divider $TL_1$ and, via an inverter IR, to a respective last input of the AND gates $a_4$ to $a_6$, which are controlled by the second divider $TL_2$.

The same output of the flipflop cell AFF is further connected to the input of the counter Z which causes the counter Z to be switched from forward counting to backwards counting. The other output of the flipflop cell AFF can be used, instead of the inverter IR, to control the third inputs of the AND gates $a_4$ to $a_6$. The inverter IR is then unnecessary.

Figure 7:
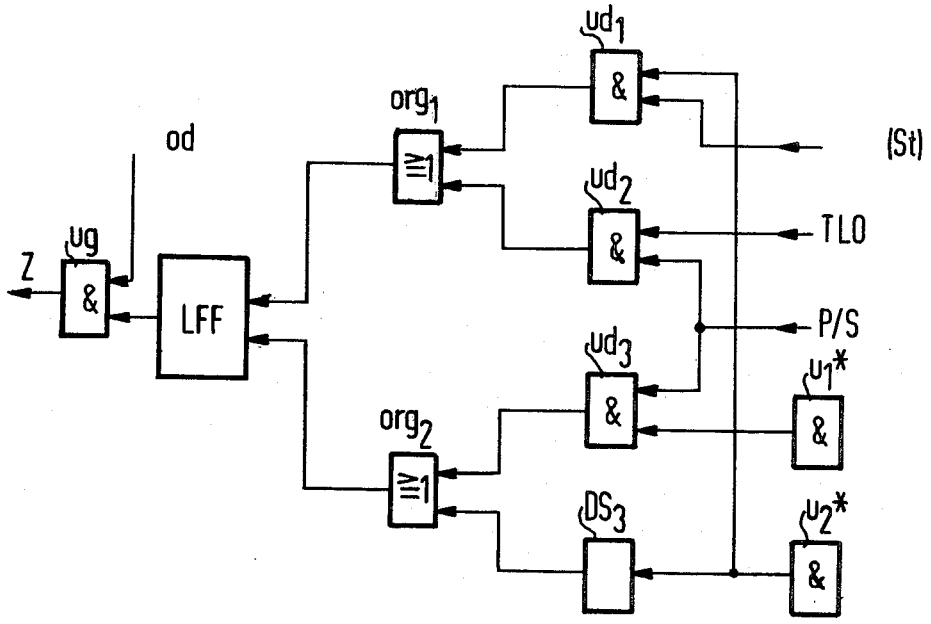

The embodiment of the logic circuit Lo shown in FIG. 7 has two AND gates controlled by the two extreme states of the bidirectional counter Z, the AND gates $u_1$* being assigned to the highest counter reading and the AND gate $u_2$* to the lowest counter reading i.e. to the counter reading "0". The AND gate $u_1$* may be identical with the AND gate $a_3$*, but in the case of the logic circuit Lo, the differentiation stage $DZ_2$ is not included. Since, in the case of the example or embodiment of the invention, the counter Z has seven counting stages i.e. seven series-connected toggle flipflop cells, the AND gates $u_1$* and $u_2$* each have seven inputs which, in the case of the AND gate $u_1$*, are connected to the outputs Q indicating the counter reading and, in the case of the AND gate $u_2$*, are connected to the outputs $\overline{Q}$ of the counter Z which carry signals inverted thereto.

The output of the AND gate $u_2$* indicating the counter reading "0" is connected via a differentiation stage DS3 to the one input of an OR gate $org_2$, the other input of which is controlled via a further AND gate $ud_3$. The output of the OR gate $org_2$ is connected to the flipflop LFF in such a manner that the latter blocks the AND gate ug controlling the feeding of counting pulses to the counter Z. The first-mentioned AND gate $ud_3$ is addressed on the one hand, by the AND gate $u_1$* devoted to the highest counter reading of the counter Z (and which is preferably identical with the AND gate $a_3$*) and, on the other hand, by a signal fed-in via a control input P/S. In the presence (or absence) of such a signal, the tone amplitude remains constant as long as the signal lasts even when the depressed key is released.

The other input of the flipflop cell LFF is controlled by a further OR gate $org_1$ which, in contrast with the OR gate $org_2$, is responsible for feeding counting pulses to the counter Z via the AND gate ug. The OR gate $org_1$ is likewise controlled by two AND gates $ud_1$ and $ud_2$. One input of the AND gate $ud_2$ is connected to the hereinafore mentioned control input P/S, while the other input is addressed by an input TLO. A signal is given to the input TLO, if the key in the keyboard responsible for the then addressing of the amplitude former $AF_1$ to $AF_p$ is released. The generation of this signal, which controls the input TLO, is discussed further hereinafter in connection with the yet outstanding consideration of the channel selector KW.

The other AND gate $ud_1$ is connected with one input thereof to the AND gate $u_2$* associated with the counter reading "0" of the counter Z, and with the other input thereof to the input St which carries the start signal and by which also the NOR gate $n_2$ is controlled. Since upon switching-on of the channel $V_1$, $V_2$, . . . $V_p$, respectively, and the amplitude former or controller $AF_1$, $AF_2$, . . . $AF_p$, respectively, the bidirectional counter Z has the counter reading "0", the OR gate $org_1$ is activated by the start signal fed-in via the start input St, and the flipflop LFF is thereby brought to an operating state in which the subsequent AND gate ug is conducting for the counting pulses supplied by the output of the OR gate od. As is evident, the state is terminated if the counter reading "0" is attained by the backwards-counting process in the counter Z and thus, a signal, by which the flipflop LFF is flipped into the other position and blocks the AND gate ug, is given to the OR gate $org_2$ by means of the differentiating stage $DS_3$ connected thereto.

If simultaneously addressed by the AND gage $u_1$* coupled to the highest counter reading of the counter Z and the signal input P/S, the AND gate $ud_3$ acts in the same sense, since also the latter then cuts off the AND gate ug via the OR gate $org_2$. In the same sense as the AND gate $ud_1$, the AND gate $ud_2$ acts upon the OR gate $org_1$and, thereby upon the flipflop LFF, the instant it is addressed simultaneously at the one input thereof by a signal which is generated when the activating key on the keyboard is released and which is fed-in via the input TLO, and at the other input thereof by a signal P/S (generated, for example, by means of a pedal).

The differentiation stages $DS_1$, $DS_2$ and $DS_3$ can advantageously be constructed in accordance with U.S. Pat. No. 4,293,780, since they trigger the immediate generation of a short defined pulse R due to a controlling pulse RZ. In the case at hand, the purpose of these differentiation stages $DS_1$ to $DS_3$ is seen in that if a control pulse of arbitrary length should occur, an extremely short pulse of defined length is triggered.

The transfer signals $UE_1$ to $UE_p$ which serve for starting the output parts $V_1$ to $V_p$ of the switching system VM associated with the respective amplitude formers or controllers $AF_1$ to $AF_p$ and which are generated by the associated AND gate $A_1$ to $A_p$ of the channel selector KW are advantageously used as start signals St, so that practically the output of the AND gate $A_1$, . . . $A_p$, respectively, assigned to the respective output part $V_1$, . . . $V_p$, respectively, is thus utilized for controlling the logic Lo in the respectively following amplitude former or controller $AF_1$ . . . $AF_p$ for furnishing the start signal St. As stated hereinbefore, they are brought via the differentiating stage $DS_1$ to the NOR gate $n_1$ as well as to the AND gate $ud_1$ in the logic circuit Lo.

Due to the conditions indicated and the start signal St, a "1" appears at the output of the NOR gate $n_1$, which is delivered to one of the three inputs of the AND gate $a_3$ which is controlled by the third divider stage $F_3$ of the divider $TL_1$. Furthermore, due to the starting state of the counter Z (be it due to a preceding backwards count to the counter reading "0" or due to a reset signal given via the reset input Re), the flipflop AFF is in a state wherein the AND gates $a_1$ to $a_3$ are addressed with a "1" by this flipflop AFF. Finally, the two oscillators $OZ_1$ and $OZ_2$ are continuously in operation (they can be switched on, for example, by the start signal St). Thus, counting pulses arrive via the AND gate $a_3$, the OR gate od and the AND gate ug which, because they come from the last stage $F_3$ of the divider $TL_1$, appear with a relatively low frequency. These counting pulses count the counter Z gradually up to the counter reading associated with the AND gate $a_1$*. In the interim the audio-frequency signals which are transmitted due to the control of the former or controller circuit FS by the counter Z from the former circuit to the mixing stage MI and are supplied by the respectively associated output part $V_1$ to $V_p$, are successively increased; because the counter Z is counted up relatively slowly, the amplitude is increased only relatively slowly.

If the AND gate $a_1$* then responds when the counter reading of the counter Z associated therewith is reached, the "1" at the output of the NOR gate $n_1$ disappears. On the other hand, a "1" then appears at the output of the NOR gate $n_4$. As a result, the supply of the counting pulses delivered by the divider stage $F_3$ is stopped and the supply of counting pulses coming from the divider stage $F_2$ via the AND gate $a_2$ is enabled, since the operating state of the two flipflops LFF and AFF has not changed and, also, the inputs St and Re were no longer addressed. Because the counting pulses now appear with a higher frequency then before, the amplitudes of the audio signals supplied by the former or controller circuit FS increase faster than before and, indeed, until the AND gate $a_2$* controlled by the higher counter reading of the counter Z responds.

If the AND gate $a_2$* responds, the "1" at the output of the NOR gate $n_4$ disappears and appears instead at the output of the NOR gate $n_6$. This terminates the supply of counting pulses from the divider stage $F_2$ and, instead, the AND gate $a_1$ is made to transmit the counting pulses stemming from the first divider stage $F_1$. Thereby, the amplitude increase of the audio-frequency signals delivered at the output of the former circuit FS progresses even faster than before. When the counter reading associated with the AND gate $a_3$* is reached, the "1" at the output of the NOR gate $n_6$ disappears. In addition, the flipflop AFF is flipped. This changes the direction of counting in the counter Z. Moreover, the AND gates $a_1$ to $a_3$ which are addressed by the oscillator $OZ_1$ are replaced, as far as the action thereof for feeding-in the counting pulses is concerned, by the AND gates $a_4$ to $a_6$, which are addressed by the oscillator $OZ_2$.

Initially, only the state "0" prevails, however, at the outputs of the NOR gates $n_1$, $n_4$ and $n_6$ which also control these AND gates $a_4$ to $a_6$, so that, provisionally, no counting pulses arrive at the counter Z, and the amplitudes of the audio frequency signals, which are delivered via the former circuit FS to the mixing stage Mi, retain the highest value thereof. To terminate this state, the RS-flipflops formed by the NOR gates $n_1$ to $n_6$ must go into action again, and the flipflop $n_1$, $n_2$ must then terminate the operation thereof by a higher counter reading than the flipflop $n_3$, $n_4$, and the flipflop $n_5$, $n_6$ must terminate the action thereof with the counter reading "0". This means that the control of the AND gates $a_1$*, $a_2$* and $a_3$* by the counter Z must be modified appropriately, or these AND gates must be replaced by accordingly differently controlled AND gates. The representation of the switching means in word and picture calls fundamentally for nothing more than the use of control means realized by AND and OR combinations, which, due to a switching or a second start signal, effect the appropriate change of the three RS-flipflops formed by the NOR gates $n_1$ to $n_6$ and/or the AND gates addressing them. In the connection of these three RS-flipflops shown in FIG. 6, the NOR gate $n_1$ would then have to be switched again for initiating the decay phase in such a manner that, at the output thereof, a "1" appears which disappears again when the counter reading of Z corresponding to the AND gate $a_1$* is reached, while, at the same time, the "1" appears at the output of $n_4$. When the next-lower counter reading of Z associated with the AND gate $a_2$* is reached, the "1" at the output of the NOR gate $n_4$ disappears. Instead, the "1" appears at the output of the NOR gate $n_6$ and disappears again as soon as the counter reading "0" now associated with the AND gate $a_3$* is reached in the counter Z.

It is clear that, also for accomplishing this "reverberation effect" or sustaining effect, the AND gate ug must transmit the counting pulses supplied by the OR gate od and, therefore, no "1" must be present at the OR gate $org_2$. The conditions required therefor can be seen directly from FIG. 7. It should further be mentioned that the signals appearing at the output which is not connected to the AND gate ug can be used as an indication that the counter has the content "0" and is therefore ready to receive.

Figure 8:
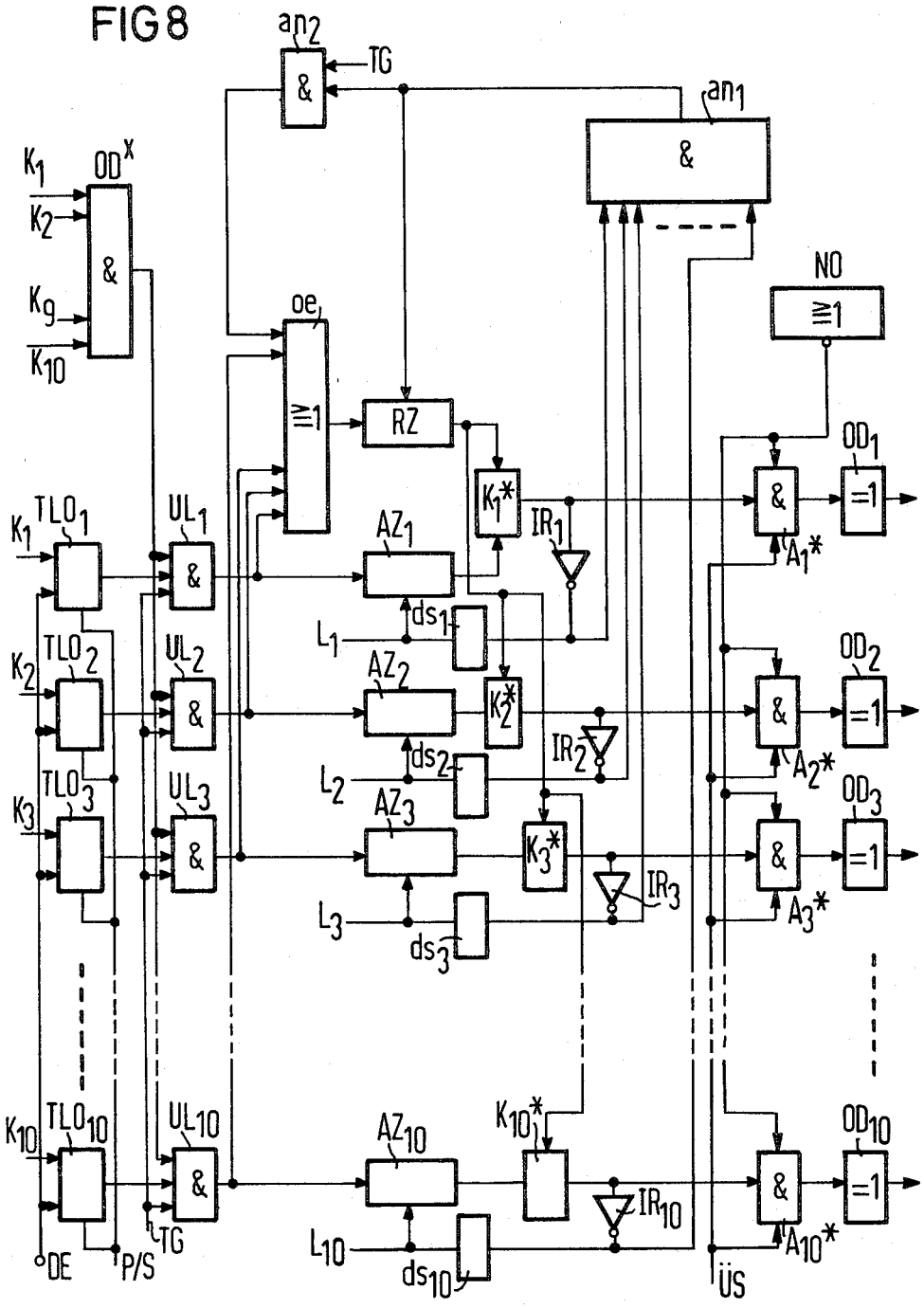

For concluding the description of the channel selector KW according to FIG. 3, reference is made to FIG. 8, wherein the connection of the reference counter RZ and the age or priority time counters $AZ_1$ to $AZ_p$ already shown in FIG. 3 is shown (in the example, p is again equal to 10).

The control AST of the age or priority time counters $AZ_1$ to $AZ_p$ i.e. $AZ_1$ to $AZ_{10}$ in the case of the example or embodiment of the invention indicated only in FIG. 3, is shown in FIG. 8.

Each age counter $AZ_1$ to $AZ_p$ is assigned to a respective one of the output channels $V_1$ to $V_p$ of the provided switching system FM. In the embodiment example shown in FIG. 8, the counting input thereof is addressed by the output of a respective AND gate $UL_1$, $UL_2$, . . . $UL_p$. Furthermore, each of the age counters $AZ_1$ to $AZ_p$ can be reset to the counter reading "0" by a clearing signal $L_1$ to $L_p$ furnished by the respective associated amplitude former $AF_1$ to $AF_p$ when the latter returns to the starting state, as well as by a non-illustrated general reset signal.

All age counters have the same number of counting stages, which applies also to the reference counter RZ assigned jointly to the age or priority time counters $AZ_1$ to $AZ_p$. Between the reference counter RZ and each of the provided age counters $AZ_1$ to $AZ_p$, comparators $K_1$* to $K_p$* are provided, which have been mentioned hereinbefore and which respond i.e. deliver a "1", when the counter reading of the reference counter RZ and the individual age or priority time counters $AZ_1$, $AZ_2$ and so forth, respectively are equal.

The AND gates $UL_1$ to $UL_p$ respectively assigned to the individual age counters $AZ_1$ to $AZ_p$ provide the clock pulses for the respective age or priority time counters. In the case of the example or embodiment of the invention, these AND gates $UL_1$ to $UL_p$ each have three inputs. Of these, one is addressed by the OR gate OD* which is shown in FIG. 3 and is controlled by the comparators $K_1$ to $K_p$ of the individual output channels $V_1$ to $V_p$, and which then always delivers a "1" if at least one of the output channels $V_1$ to $V_p$ is occupied.

(If it is intended that the activation of the age counters and the clock pulse supply thereof, respectively, are instituted only if all channels $V_1$ to $V_p$ are occupied, the OR gate AD* must be replaced by an appropriate AND gate).

Figure 9:
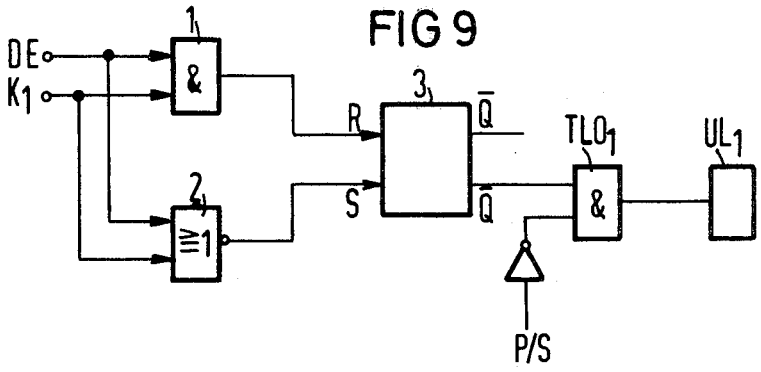

With each of the output channels $V_1$ to $V_p$ and, therefore, with each of the age or priority time counters $AZ_1$ to $AZ_p$, a circuit arrangement $TLO_1$ to $TLO_p$ is further associated which may be constructed, for example, in accordance with FIG. 9 and which responds if the key causing the drive of the individual channel $V_1$ to $V_p$ and thereby, of the associated age or priority time counter $AZ_1$ to $AZ_p$ is again released. It supplies a signal which is provided for controlling the second input of the AND gate $UL_1$ and $UL_2$ and so forth, respectively, of the individual age or priority time counters $AZ_1$, $AZ_2$ and so forth, so that the respective age or priority time counter $AZ_1$, $AZ_2$ and so forth, respectively, receives counting pulses only if the key is released or the operation of the aforementioned circuit parts is blocked by a (common) signal P/S. The third inputs of the individual AND gates $UL_1$ to $UL_p$ are addressed jointly by clock pulses. These clock pulses can be supplied, for example, by the clock generator TG controlling the input shift register PSW.

From the just-described connection of the AND gates $UL_1$ to $UL_p$, it will be understood that the counter which shows the highest counter reading, is the one wherein the continuous signal supplied by the circuit part TLO is in effect longest.

The outputs of the respective AND gates $UL_1$ to $UL_p$ associated with the individual age or priority time counters $AZ_1$ to $AZ_p$ are each connected to a respective input of a common OR gate oe, the output of which furnishes the counting pulses for the reference counter RZ. Thus, each counting pulse fed to one of the age or priority time counters $AZ_1$ to $AZ_p$ serves, simultaneously, as a counting pulse for the reference counter RZ.

As mentioned hereinbefore, a comparator $K_1$* to $K_p$*, respectively, is provided between the reference counter RZ and each of the age counters $AZ_1$ to $AZ_p$. The output of these comparators $K_1$* to $K_p$* serves, on the one hand, for controlling a respective AND gate $A_1$* to $A_p$*. It serves, on the other hand, by means of an inverter $IR_1$, $IR_2$, . . . $IR_p$, respectively, for controlling the reset input of the age counter $AZ_1$, $AZ_2$, and so forth, respectively, which is addressed for this purpose via the differentiating stage $ds_1$, $ds_2$, . . . $ds_p$, respectively, from the output of the associated inverter $IR_1$ to $IR_p$ by a short reset pulse, if the "1" at the corresponding comparator $K_1$*, $K_2$* and so forth disappears. The output of the inverters $IR_1$ to $IR_2$ addressed individually by the comparators $K_1$* to $K_2$* is further connected to a respective input of an AND gate $an_1$ jointly assigned to all the comparators $K_1$* to $K_p$*.

The reference counter RZ is constructed as a bidirectional counter which is switched to the opposite direction of counting by a signal supplied by the AND gate $an_1$ and which flips immediately into the forward-counting direction in the absence of such a signal. The output of the AND gate $an_1$ is, moreover, connected to an input of a further AND gate $an_2$, the output of which is connected to a further input of the OR gate oe controlled by the AND gates $UL_1$ to $UL_p$, and the other input of which is controlled by clock pulses, for example, by the clock pulses TM.

Thus, if due to a "1" at the output of the AND gate $an_1$, a reversal of the counting direction of the reference counter RZ occurs, the latter receives counting pulses via the AND gate $an_2$ until one of the comparators and, specifically, the comparator which is assigned to the age or priority time counter with the highest counter reading, received a "1" at the input thereof, so that equality of the counter reading of the reference counter and the counter reading of one of the age or priority time counters $AZ_1$ to $AZ_p$ is restored.

A response of the individual comparators $K_1$* to $K_p$* i.e. the appearance of a "1" at the output means thereof, as emphasized repeatedly, signifies that equality exists between the counter reading of the reference counter RZ and the counter reading of an age or priority time counter. An exception is the starting state since then not only one comparator, but all of them deliver a "1" so that, for this reason alone, the reference counter RZ is kept initially at the counter reading "0". After the first output channel $V_1$ is addressed, the OR gate OD* responds. The first counting pulse for an age or priority time counter $AZ_1$ to $AZ_p$, however, is due only if one of the circuit parts $TLO_1$ to $TLO_p$ responds. Because of the dependence of the counting pulses on the third inputs of the AND gates $UL_1$ to $UL_p$, which come from a common clock generator and are therefore synchronous with each other, the counting pulses then appear at the output of that AND gate $UL_1$, $UL_2$, . . . $UL_p$, respectively, which is addressed by the signal TLO i.e. by the respectively associated indicator $TLO_1$ to $TLO_p$. These counting pulses then arrive at the counting input of the age or priority time counter belonging to that AND gate $UL_1$ to $UL_p$ which then transmits the counting pulses, as well as via the OR gate oe to the counting input of the reference counter RZ, so that the same counter reading builds up in both counters.

If a second channel is then loaded and the key causing the load on this channel, for example, the channel $V_2$, is released, the age counter assigned to this channel, in the case of the example or embodiment of the invention, the age or priority time counter $AZ_2$, then also receives the synchronous counting pulses, so that in this age or priority time counter $AZ_2$ also and in all other age or priority time counters which belong to a given output channel and are addressed by one of the signals TLO, an individual counter reading is built up which is all the lower, the later the respective age or priority time counter was addressed by the TLO signal assigned thereto.

A clearing pulse which is generated by the first-responding output channel $V_1$ or the amplitude former or controller thereof and is applied to the reset input of the age or priority time counter $AZ_1$ provides that the counter reading of the age or priority time counter with the highest counter reading is cleared. Therewith, the "1" at the output of the corresponding comparator $K_1$* and so forth disappears, so that the reference RZ is set back to the counter reading of the age or priority time counter which has the next-to-the-highest counter reading, respectively, for example, that of the age or priority time counter $AZ_2$. Then the comparator assigned to this age or priority time counter, for example, to the age or priority time counter $AZ_2$, that is, the comparator $K_2$ responds with a "1" at the output thereof, so that the backwards counting of the reference counter RZ is abruptly terminated. The following counting pulses are then fed in positive sense to the age or priority time counter which then has the highest counter reading, for example, $AZ_2$, and to the reference counter RZ, until also the reading $AZ_2$ is set back to the counter reading "0" by a clearing signal $L_2$ supplied by the corresponding channel $V_2$ or the amplitude former or controller $AF_2$. If, for example, the age or priority time counter $AZ_5$ is the age or priority time counter with the next-highest counter reading, the process described is repeated with the latter, in that the reference counter is reset back to the counter reading of this age or priority time counter $AZ_5$, is then counted up by positive drive with the common clock pulses synchronously with the new age or priority time counter $AZ_5$ until the counter reading also of this counter is cleared by a clearing signal $L_5$ coming from the amplitude former $AF_5$, and the reference counter RZ is set to a new counter reading, namely, to the next-to-the-highest counter reading.

Since the clearing of the age counters is synchronous with the clearing of the respective tone address stored in the memory parts S and S* of the associated output channel $V_1$, $V_p$, the released channel can be addressed again, as was previously described hereinbefore. If this tone address is cleared because the played tone is decaying by age without the newly depressed key and a signal "transfer" being the thing triggering the clearing signal, this means that no "1" is present at the output of the NOR gate NO (FIG. 3) and, therefore, the reoccupation of the released output channel can proceed in the previously described manner, with the respective associated AND gate from the series of AND gates $UG_1$ to $UG_p$ being used for the transmission. If, on the other hand, all channels $V_1$ to $V_p$ are occupied, and at least one key is already released, the control of the AND gates $A_1$ to $A_p$ and the OR gates $OD_1$ to $OD_p$, respectively, by the AND gates $A_1$* to $A_p$* becomes effective.

The comparator $K_1$*, $K_2$* and so forth, respectively, which is controlled by an age or priority time counter and has the highest counter reading has a "1" at the output thereof, while all the others of these comparators have a "0" at the output thereof. If the AND gates $A_1$* to $A_p$* equipped with two inputs are then provided with a third input, this third input is controlled by a common overwriting signal ÜS, and the signal delivered at the output of the individual AND gate $A_1$* to $A_p$* is used not only for controlling the corresponding OR gate from the OR gate series $OD_1$ to $OD_p$, but also this signal is used simultaneously as a second clearing signal for the content of the memory parts S and S* of the respectively corresponding output channel, then what it is automatically achieved thereby is that, upon application of an overwriting signal ÜS to the totality of the AND gates $A_1$* to $A_p$*, with the output channels $V_1$ to $V_p$ completely occupied, the channel with the farthest decayed tone signal in the associated amplitude former or controller is released immediately and is occupied by the newly-played tone signal.

A circuit for generating the signal TLO is shown in FIG. 9. There, the data input DE of the channel selector KW and the comparator $K_1$ are connected to a respective input of a NOR gate 2. The output of the AND gate 1 controls the reset input R of an RS flipflop 3, and the output of the NOR gate controls the setting input S of this flipflop 3. The $\overline{Q}$-output is connected to one input of a further AND gate $TLO_1$, the output of which supplied the signal TLO. The second input of the AND gate $TLO_1$ is controlled via an inverter by the input P/S.

Since, during each counting period of the tone address counter TAZ, coincidence of a "1" at the output of the respective comparator $K_1$ with a "1" at the data input DE occurs exactly once if they key addressing the channel $V_1$ is still depressed, a permanent "1" occurs at the output $\overline{Q}$ of the RS-flipflop 3 only if the "1" at the data input DE no longer appears at the instant of the response of the comparator $K_1$ i.e. in other words, the respective key is released.

Figure 10:
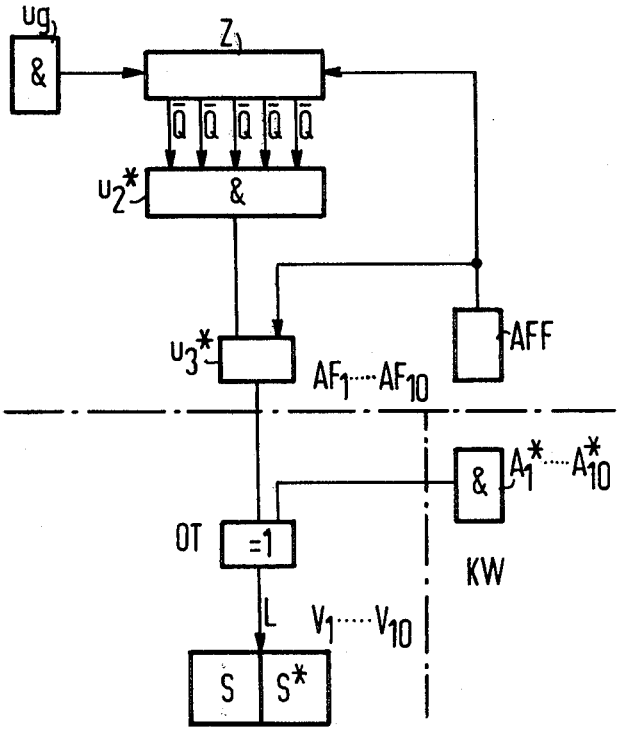

In FIG. 10, a possibility is shown for supplying the individual output channel ($V_1$, . . . $V_p$) with the tone addresses which are stored, respectively, in the respective output channel in the clearing process due to aging, based upon a clearing pulse supplied by the respective associated amplitude former or controller ($AF_1$, . . . $AF_p$) or upon a clearing pulse to be supplied if the stored information is prematurely replaced by new information.

The AND gate $u_2$*, which is associated with the bidirectional counters (Z) in the individual amplitude formers or controllers ($AF_1$, . . . $AF_p$) and responds at the counter reading "0", is connected with the output thereof to the one input of a further AND gate $u_3$*, the other input of which is addressed jointly with the control input of the bidirectional counter Z controlled by the flipflop AFF (FIG. 6) for the duration of the operating state of backwards counting. Accordingly, the AND gate $u_3$* responds only if, during backwards counting, the counter reading "0" in the counter Z is reached.

The "1" produced thereby at the output of the AND gate $u_3$* can be applied, for example, via an OR gate OT to the common reset 3 input of the two memory parts S and S* (for example, to the gate of the transfer transistor $t_4$ in a construction according to FIG. 5). On the other hand, the OR gate OT is addressed also by the output of the AND gate $A_1$*, . . . $A_p$*, respectively, which is associated with the respective output channel ($V_1$, . . . $V_p$) and is controlled by the associated age or priority time counter ($AZ_1$, . . . $AZ_p$) or the comparator ($K_1$*, . . . $K_p$) associated therewith which, as explained hereinbefore, responds if the output channels $V_1$, . . . $V_p$ are completely occupied and due to an overwriting signal ÜS.

It should further be noted that also in the case of the digital circuit under consideration, a system for generating a general reset pulse, constructed in a conventional manner, may be provided. It should also be stated with respect to FIG. 10 that the clearing signal L delivered at the output of the OR gate OT is used, in any case, for example by flipping the flipflop AFF into the other operating state as well as by resetting the RS-flipflop $n_1$ to $n_6$ to the starting state (the signal L then represents the reset signal Re indicated in FIG. 6), that also the amplitude former or controller $AF_1$, . . . $AF_p$ associated with the respective output channel $V_1$, . . . $V_p$ is spontaneously reset to the starting state.

It is understood that modifications of the hereinaforedescribed embodiment of a digital semiconductor circuit according to the invention then becomes possible to a man of skill in the art who reads the forgoing information.

There are claimed:

1. Digital semiconductor circuit for an electronic organ having a plurality of control inputs, respectively, associated with individual playing keys of a keyboard of the organ and having a lesser number of audio signal outputs compared to the number of control inputs, as well as an audio frequency generator for applying electrical oscillations corresponding to the individual tones of the highest octave provided within playing range of the organ to a respective audio signal input of the semiconductor circuit, wherein the individual control inputs are formed, respectively, by an information input of a respective cell of a clock-controlled shift register operated as a parallel-to-series converter, the individual playing keys and the respective control inputs associated therewith having respective connections of such construction that, in depressed condition of a respective playing key, the control input receives a level logical "1" and otherwise a level logical "0", wherein both data output of the shift register as well as clock pulses serving for control thereof serve for controlling a switching system forming a connection between the audio signal inputs and the audio signal outputs, a part of the circuit of said switching system comprising a channel selector controlled by the data output serving, in turn, for selecting the audio signal output on the basis of the respectively depressed playing key with the electrical oscillation appertaining to said playing key, the clock pulses effecting information transfer in the shift register being provided additionally also as counting pulses for a digital tone address counter serving for identifying the respectively actuated playing key and the control input associated therewith, wherein a plurality of mutually identical circuit parts forming, respectively, an output channel of said switching system, are provided having a signal output forming, respectively, one of said audio signal outputs, said circuit parts, in turn, being fed in similar manner by all electrical oscillations delivered via said audio signal inputs and also being controlled by said channel-selector circuit part of said switching system serving for selecting the respective audio signal output to be addressed, as well as by said digital tone address counter, wherein the individual audio signal outputs are applied to respective mutually identical circuit parts each comprising an amplitude controller serving for improving audio quality and for influencing the amplitude of the electric audio signal oscillations delivered by the respective audio signal output, said amplitude-controller circuit parts having outputs for controlling in common an electroacoustic transducer, and wherein the circuit parts of which said switching system is comprised have such a construction that, due to actuation of a playing key of the keyboard, each logical "1" transmitted by said data output of the shift register leads directly to addressing of one of said audio signal outputs by the electrical oscillation associated with the respective playing key and received directly or due to frequency division in said switching system due to addressing of the individual audio signal inputs, and that said one audio signal output thus selected is such that the last preceding addressing of said selected one audio signal output is most distant in time when compared with the last addressing of the remaining audio signal outputs.

2. Digital semiconductor circuit according to claim 1 wherein each of said output parts of said switching system has a backwards-control output for effecting a reaction of the respective output part of said switching system on said channel selector and an additional control action on the respective amplitude controller assigned to the respective output part.

3. Digital semiconductor circuit according to claim 2 wherein said tone address counter addressable by the shift pulses of said shift register is formed of two parts, each of said output parts of said switching system having an information input part in the form of a read-write memory controllable by said channel selector and said tone address counter, said read-write memory having two parts, a first part of the read-write memories being addressable by a first part of said tone address counter, and a second part of said read-write memories by a second part of said tone address counter, said first part of said tone address counter and said memory being adapted to control said switching system based upon tone designation, and said second part of said tone address counter being adapted to control said switching system based upon the octave containing a respective played tone of the keyboard.

4. Digital semiconductor circuit according to claim 3 wherein said first part of said tone address counter is formed of four series-connected counter stages, and said second part of said tone address counter of at least three series-connected counter stages; a counting input of a first counter stage of said first part of said tone address counter being addressable by the shift pulses for operating said shift register, a counting input of said second part of said tone address counter being connected to outputs of said counter stages of said first part of said tone address counter for transmitting a counter reading of said first part of said tone address counter in such a manner that said second part of said tone address counter always receives 0 counting pulse only if an additional "0" counter reading of said first counter part is increased by twelve.

5. Digital semiconductor circuit according to claim 4 wherein said first and second parts of said read-write memory in the respective output parts of said switching system comprise respective pluralities of memory cells, the information input of the memory cells of said first memory part is adapted to receive the counter reading of the first part of said tone address counter, and the information input of the memory cells of said second memory part is adapted to receive the counter reading of the second part of said tone address counter, the content of said first memory part being effective for controlling acceptance of information present at said audio signal inputs of said switching system by the respective individual output parts of said switching system, and the content of said second memory part being effective for controlling transmission of said information to said audio frequency outputs of said respective output parts of said switching system.

6. Digital semiconductor circuit according to claim 5 including a first decoder in each of the output parts of said switching system, said first decoder being controllable by said memory cells of said first memory part, and a second decoder in each of the output parts of said switching system, said second decoder being controllable by said memory cells of said second memory part, a first and second plurality of AND gates each having two inputs and one output, said first decoder having a plurality of outputs respectively connected to one input of each of said first AND gates, the other input of each of said first AND gates being controllable by a respective one of said audio signal inputs of said switching system addressable by the oscillator arrangement, said one output of said first AND gates, respectively, being connected to a respective input of a first OR gate having an output, said second decoder having a plurality of outputs respectively connected to one input of each of said second plurality of AND gates, the other input of each of said second AND gates being controllable via said output of said first OR gate in a varying manner, said output of said second AND gates being respectively connected to a respective input of a second OR gate having an output forming a tone signal output of the respective circuit part comprising said audio frequency outputs of said switching system.

7. Digital semiconductor circuit according to claim 6 wherein the respective outputs of said first OR gate of each output part of said switching system connected to the respective one input of said second AND gates controllable by said second decoder are also connected to a signal input of a frequency divider, said frequency devider having a number of divider stages at least equal to the number decreased by one of the outputs of said second decoder, and signal outputs of at least the first divider stages are connected to a respective further one of said second AND gates controllable via said second decoder.

8. Digital semiconductor circuit according to claim 7 wherein said output parts of said switching system are output channels having respective control inputs associated therewith, said two memory parts of each of said output channels being controllable by said channel selector via said control inputs, respectively.

9. Digital semiconductor circuit according to claim 8 including respective comparators associated with said output channels for monitoring each of the memory cells of said two memory parts in the individual output channels with respect to signal input from said tone address counter and to information output to said decoder, said comparators, respectively, being constructed so as to deliver a signal "1" if the counter reading at said tone address counter is in agreement with a counter reading stored in the two memory parts of the respective output channel and representing the tone address of the key addressing the respective output channel, said comparators having a "0" at the output thereof when said last-mentioned counter readings are not in agreement.

10. Digital semiconductor circuit according to claim 9 wherein said memory cells of said two memory parts in said output channels are not connected to one another and have respective data inputs connected to a respective output of said tone address counter co-transmitting the counter reading, said memory cells having respective data outputs connected to a respective input of a respective decoder addressable by the respective memory cell.

11. Digital semiconductor circuit according to claim 10 wherein said memory cells, respectively, of the two memory parts of the respective output channels are formed of clock-controlled quasi-static shift register cells.

12. Digital semiconductor circuit according to claim 6 wherein said audio signal inputs are tone signal inputs and are associated with a respective tone of the highest octave for supplying the appropriate square waves thereof, ans wherein said frequency divider has a plurality of divider stages commensurate with the number of octaves.

13. Digital semiconductor circuit according to claim 12 wherein said output of said first OR gate controllable by said first decoder, and the signal outputs of each of said divider stages of said frequency divider are combined with a respective output of said second decoder by said second AND gates, the outputs of the respective second AND gates being connected to a respective input of the second OR gate forming the tone signal output of the respective output channel.

14. Digital semiconductor circuit according to claim 13 wherein said amplitude controllers assigned to said audio signal outputs, respectively, of said switching system comprise a controller circuit controllable by a respective bidirectional counter and having an output, and including a mixing stage common to said audio signal outputs, said mixing stage having inputs connected to said outputs of said controller circuits, and further including an electroacoustic transducer connected to an output of said mixing stage.

15. Digital semiconductor circuit according to claim 14 including a respective oscillator common to all of said amplitude controllers of said controller circuit for addressing said bidirectional counters controlling said controller circuit, a logic circuit, respectively, controllable individually in the respective amplitude controllers and at least one additional frequency divider, said oscillator, respectively, furnishing counting pulses to the respective bidirectional counter via said logic circuit and via said additional frequency divider.

16. Digital semiconductor circuit according to claim 15 wherein said amplitude controllers, respectively, comprise a plurality of RS-flipflops controllable by respective counting outputs of said bidirectional counter and being responsive at a given counter reading, said flipflops having a respective output for controlling at one input of said respective logic circuit, conduction of respective additional AND gates for sequence of counting pulses delivered by the respective oscillator via the respective divider stages of said at least one frequency divider, said logic circuit having another input controllable by various signals serving to operate the overall circuit.

17. Digital semiconductor circuit according to claim 16, including a further flipflop controllable via said RS-flipflops, said further flipflop being switchable, when a maximum counter reading is reached in said bidirectional counters of said individual amplitude controllers, from a previous first operating state of said further flipflop associated with the forward-counting direction of said bidirectional counter into a second operating state thereof associated with the backwards-counting direction of said counter, the signal generated at the output thereof due to the switch-over being applicable for switching said counter into said backwards-counting direction.

18. Digital semiconductor circuit according to claim 17 including means actuable when a counter reading "0" has been reached during backwards counting in said bidirectional counter in the respective amplitude controllers, for delivering a clearing pulse for placing the operating state of the output channel of said switching system respectively associated with the respective amplitude controller into the starting state thereof.

19. Digital semiconductor circuit according to claim 18 wherein the bidirectional counter in the respective amplitude controllers have outputs for indicating the inverted counter reading and for addressing another AND gate resonsive only to a counter reading of "0", said other AND gate having an output for controlling an input of yet a further AND gate, said further AND gate having another input controllable together with the control input controlling the backwards counting direction through said further flipflop controllable via said RS flipflops by the respective counter, said further AND gate having an output for delivering a clearing signal for the audio address stored in the respective output channel.

20. Digital semiconductor circuit according to claim 19, wherein said channel selector comprises a plurality of AND gates corresponding in number to that of said output channels and respectively having two inputs, said data input addressed by the signal output of said shift register being connected to a respective one of the inputs of said last-mentioned plurality of AND gates, the respective second inputs thereof being controllable by a backwards-control output of the respective output channel carrying a signal "0" when the output channel is occupied, and a signal "1" when the output channel is unoccupied, said last-mentioned plurality of AND gates having an output causing transfer of the counter reading corresponding to the tone address of the key causing the next "1" at said data input of said channel selector from said tone address counter into said memory of the respective output channel.

21. Digital semiconductor circuit according to claim 20 including a common NOR gate connected to said outputs of said two memory parts indicating information content stored in said memory parts of said respective output channels, said common NOR gate having an output forming backwards-control output of the respective output channel.

22. Digital semiconductor circuit according to claim 21 wherein each of said second inputs of said last mentioned plurality of AND gates which are not connected to said data input and cause information transfer from said tone address counter to the respective output channel is controllable by another AND gate assigned likewise to the respective output channel, each of said other AND gates having a first signal input controllable by said backwards control output of the respective signal input and a second signal input controllable by the totality of said output channels via a common AND gate, said other AND gates, except for said other AND gate associated with a first one of said output channels, having a third input through which a sequence in the addressing of the respective output channels is controllable via a respective logic circuit.

23. Digital semiconductor circuit according to claim 20 wherein said backwards-control output of said one of said output channels is connected via an inverter to the third input of one of said other AND gates associated with a second one of said output channels and being addressable directly by said backwards-control output of said second output channel, said other AND gates other than said exception thereof, which are controllable between respective adjacent ones thereof directly by said backwards-controlling input of the respective output channel, being connected via said third inputs thereof, respectively, to the input of a respective inverter having an output, said output of the respective inverter and said backwards-control output of said other AND gates other than said exception thereof being directly addressable by the respective backwards-control output and being connected to a respective input of a NOR gate having an output connected to said third input of a respective other AND gate associated with the respective next output channel and addressable by the latter through said backwards-control output thereof.

24. Digital semiconductor circuit according to claim 23 including a respective OR gate disposed between the AND gate causing the respective output channel to be addressed by said common tone address counter and said other AND gate associated with the same output channel, said OR gate, respectively, having an output which is addressed at the input, which is not addressed by said data input, of the AND gate causing addressing of the output channel so as to cause entry of information into said output channel and simultaneously, by applying a start signal to the respective amplitude controller, starting operation thereof, said amplitude controller having an input addressable by the output of said other AND gate associated with the respective output channel which is directly controlled by the backwards-control output of the respective output channel.

25. Digital semiconductor circuit according to claim 24 wherein said comparators associated with the respective output channels have outputs for controlling common OR or AND gates.

26. Digital semiconductor circuit according to claim 25 including a respective priority time counter associated with each of said output channels, and a common reference counter having a plurality of counting stages corresponding in number with that of said priority time counters, said common reference counter being a bidirectional counter, a respective comparator connected between each of said priority time counters and said common reference counter and being responsive to equality of the counter readings in said common reference counter and the respective priority time counter, said comparator, respectively, having an output for reoccupying the respective output channel via the respective OR gate located between the respective two AND gates associated with the respective output channel.

27. Digital semiconductor circuit according to claim 26 wherein said output of the respective comparators associated with the respective priority time counters is connected via respective added AND gates associated with the respective output channels to a second input of the OR gate controlling the respective first-mentioned AND gate associated with the respective output channel for causing information to be entered into the respective output channel.

28. Digital semiconductor circuit according to claim 27 wherein said added AND gate connected to the respective comparator is co-controllable with a second input by said backwards-control outputs of the totality of said output channels via a common NOR gate.

29. Digital semiconductor circuit according to claim 28 wherein said added AND gate which is connected to the respective comparator and forms a connection with the first-mentioned AND gate associated with the respective output channel and causing addressing of the respective output channel is controllable with the respective others of said added AND gates jointly at a third input by a signal serving for overwriting, said added AND gate having an output at which a signal is provided for clearing the tone address stored in the respective output channel.

30. Digital semiconductor circuit according to claim 29 wherein said output of said added AND gate connected to the comparator associated with the respective age counters is connected via an OR gate to the clearing input of said memory parts provided in the respective output channel, said OR gate having another input addressable by a clearing signal supplied from the amplitude controller associated with the respective output channel.

31. Digital semiconductor circuit according to claim 30 including means actuable by the clearing signal serving for clearing the tone address stored in a respective output channel and supplied by the amplitude controller associated therewith or by a clearing signal generated due to an overwrite signal for simultaneously clearing a counter reading present in the respective priority time counter.

32. Digital semiconductor circuit according to claim 30 including means for supplying the counting input of each priority time counter, respectively, with counting pulses via the output of yet another respective AND gate, the counting input of said reference counter being suppliable with counting pulses via the output of an OR gate, the output of said yet another AND gates associated with the respective priority time counter being connected to a respective input of said last-mentioned OR gate supplying the reference counter with counting pulses, said yet another AND gates supplying the counting pulses for the respective priority time counters and for said reference counter having three inputs, respectively, one of said inputs being addressable by an OR gate jointly controllable by said backwards-control outputs of said output channels or a respectively connected AND gate, the second of said inputs being addressable by clock pulses synchronously appearing at all of said yet another AND gates, and the third of said inputs being addressable by a circuit part associated with the respective priority time counter upon release of the key in the keyboard addressing the respective output channel associated with the respective priority time counter.

33. Digital semiconductor circuit according to claim 32, wherein the respective comparators associated with the respective priority time counters are provided for generating a clearing signal appearing when the "1" disappears at the output of said comparator for the counter reading of the priority time counter, and a further signal causing resetting of the counter reading of said reference counter to the counter reading of the priority time counter showing the next higher counter reading.

34. Digital semiconductor circuit according to claim 33, wherein the output of the respective comparators is connected via a respective inverter to the clearing input of the respective priority time counter, the outputs of the respective inverters being connected to an input of an AND gate having a plurality of inputs, and the output of the last-mentioned AND gate being provided for switching the direction of counting in said reference counter from forward counting direction to opposite counting direction for the duration of a "1" present at said output of said AND gate as well as for controlling backward-counting pulses fed the counting input of said reference counter.

35. Digital semiconductor circuit according to claim 33, wherein the circuit part associated with the respective priority time counter or the counting pulse supply thereof contains an AND gate with two inputs, one of said inputs being addressable by the respective comparator in the respective output channel associated with the corresponding priority time counter, and the other of said inputs being addressable by the data input of said channel selector.

36. Digital semiconductor circuit according to claim 32, wherein the circuit part responsive upon the release of the key on the keyboard (M), which is temporarily associated with an occupied output channel with occupied priority time counter, contains an AND gate and a NOR gate, each having two inputs, one input of each of said gates being controllable by the data input of said channel selector and the other input of each of said gates by the comparator associated with the respective output channel and being addressable by the latter as well as by said tone address counter, the outputs of both said gates being connected to a respective input of an RS-flipflop, a signal co-controlling said yet another AND gate and transmitting the counting pulse for the associated priority time counter being able to be taken off at the output of said RS-flipflop having the state "1" if a "0" is present at the output of the first-mentioned AND gate.

37. Digital semiconductor circuit according to claim 2 wherein the circuit part responsive when the key on the keyboard, which is temporarily associated with an occupied output channel with an occupied priority time counter, is released, contains an AND gate with an input addressed by the data input of said channel selector and an input controllable by the comparator in the associated output channel, and a monostable multivibrator which is connected to the last-mentioned AND gate and has a relaxation time which is somewhat longer than the duration of a full counting period of said tone address counter, a signal co-controlling said yet another AND gate and transmitting the counting pulses for the associated priority time counter being able to be taken off at the output of said monostable multivibrator which, in rest position thereof, has the state "1".

38. Digital semiconductor circuit according to claim 37, wherein the output of said circuit parts furnishing the control signal supplying the output of said RS-flipflop when the depressed key is released or said monostable multivibrator is connected to one input of a further AND gate provided with two inputs, the second input thereof being controllable via an inverter by a signal.

39. Digital semiconductor circuit according to claim 32, wherein the counting pulses used for addressing the reference counter and all priority time counters are supplied synchronously by a common clock generator.

40. Digital semiconductor circuit according to claim 39 wherein said clock generator is of said shift register.

* * * * *